US008648889B2

(12) United States Patent
Hisada et al.

(10) Patent No.: US 8,648,889 B2
(45) Date of Patent: Feb. 11, 2014

(54) DISPLAY DEVICE AND METHOD FOR DRIVING DISPLAY MEMBER

(75) Inventors: Yuhko Hisada, Matsusaka (JP); Ryohki Itoh, Mie (JP); Takaharu Yamada, Matsusaka (JP); Hideki Morii, Tsu (JP); Takayuki Mizunaga, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 913 days.

(21) Appl. No.: 12/085,529

(22) PCT Filed: Jun. 28, 2006

(86) PCT No.: PCT/JP2006/312851
§ 371 (c)(1),
(2), (4) Date: May 27, 2008

(87) PCT Pub. No.: WO2007/063620
PCT Pub. Date: Jun. 7, 2007

(65) Prior Publication Data

US 2009/0040243 A1 Feb. 12, 2009

(30) Foreign Application Priority Data

Nov. 30, 2005 (JP) ..... 2005-344914

(51) Int. Cl.
*G09G 5/02* (2006.01)

(52) U.S. Cl.
USPC ..... 345/694; 345/209

(58) Field of Classification Search
USPC ..... 345/88–100, 694, 209; 349/149
See application file for complete search history.

(56) References Cited

U.S. PATENT DOCUMENTS

| | | | | |
|---|---|---|---|---|
| 6,688,604 | B2 | 2/2004 | Hashimoto | |
| 6,989,876 | B2 | 1/2006 | Song et al. | |
| 2003/0011583 | A1 | 1/2003 | Yamazaki | |
| 2003/0151584 | A1 * | 8/2003 | Song et al. | 345/100 |
| 2004/0246213 | A1 * | 12/2004 | Credelle et al. | 345/87 |
| 2005/0140612 | A1 * | 6/2005 | Baek | 345/83 |
| 2005/0168424 | A1 | 8/2005 | Nakamoto et al. | |
| 2005/0184940 | A1 * | 8/2005 | Oh et al. | 345/87 |
| 2006/0055648 | A1 * | 3/2006 | Kamada et al. | 345/87 |
| 2006/0202927 | A1 * | 9/2006 | Lee | 345/88 |

(Continued)

FOREIGN PATENT DOCUMENTS

| | | |
|---|---|---|
| JP | 02-118521 | 5/1990 |
| JP | 10-010998 | 1/1998 |

(Continued)

*Primary Examiner* — Amr Awad
*Assistant Examiner* — Aaron Midkiff
(74) *Attorney, Agent, or Firm* — Harness, Dickey & Pierce, P.L.C.

(57) ABSTRACT

In one embodiment of the present invention, in an even-numbered signal line group, the arrangement sequence of the first and second signal lines is reversed between in a display area and in a non-display area, and the same goes for the arrangement sequence of the third and fourth signal lines. The ends of the first to sixteenth signal lines in the non-display area are connected to the first to sixteenth individual drivers, respectively. An odd-numbered individual driver and an even-numbered individual driver each output a corresponding one of drive signals of opposite polarity. Thus, the polarities of subpixels of the same color arranged in a first direction D1 (horizontal direction) differ between the subpixels connected to the odd-numbered signal line group and the subpixels connected to the even-numbered signal line group. That is, all of the subpixels having the same color arranged in the horizontal direction do not have the same polarity. This helps reduce a horizontal shadow.

40 Claims, 35 Drawing Sheets

(56) References Cited

U.S. PATENT DOCUMENTS

| | | | |
|---|---|---|---|
| 2007/0064190 | A1 | 3/2007 | Kim |
| 2007/0205972 | A1 | 9/2007 | Asao et al. |
| 2009/0040243 | A1 | 2/2009 | Hisada et al. |

FOREIGN PATENT DOCUMENTS

| | | |
|---|---|---|
| JP | 11-295717 | 10/1999 |
| JP | 2003-084734 | 3/2003 |
| JP | 2003-295157 | 10/2003 |
| JP | 2004-078218 | 3/2004 |
| JP | 2002-202377 | 7/2005 |
| JP | 2005-202348 | 7/2005 |
| JP | 2006-195436 | 7/2006 |
| JP | 2007-079544 | 3/2007 |
| JP | 4938685 | 3/2012 |
| WO | 2004/092812 | 10/2004 |

* cited by examiner (a)

(b)

Conventional Art

Conventional Art

Conventional Art

Conventional Art

Conventional Art

Conventional Art

DISPLAY DEVICE AND METHOD FOR DRIVING DISPLAY MEMBER

PRIORITY STATEMENT

This application is the national phase under 35 U.S.C. §371 of PCT International Application No. PCT/JP2006/312851 which has an International filing date of Jun. 28, 2006, which designated the United States of America and which claims priority on Japanese application number 2005-344914, which has a filing date of Nov. 30, 2005 the entire contents of each of which are hereby incorporated herein by reference.

TECHNICAL FIELD

The present invention relates to display devices and methods for driving a display member. More particularly, the present invention relates to a technology for reducing a shadow (crosstalk).

BACKGROUND ART

FIG. 30 is a schematic diagram illustrating a conventional driving method (Example 1) of a liquid crystal panel. As shown in FIG. 30, in a liquid crystal panel 100Z1, subpixels 103Z are arranged in a matrix. The subpixels 103Z of three different colors, namely red (R), green (G), and blue (B), are arranged in rows (in a horizontal direction in the figure) in this order in such a way as to form a repeating pattern thereof, and the subpixels 103Z of the same color are arranged in columns (in a vertical direction in the figure).

In the figure, symbols "+" and "−", with one of which each subpixel 103Z is marked, represent the polarity of the subpixel 103Z (the polarity of the voltage at a subpixel electrode (also called a pixel electrode) of the subpixel 103Z). FIG. 30 shows the polarities observed when so-called dot inversion driving is performed.

FIG. 31 is a schematic diagram illustrating another conventional driving method (Example 2). As shown in FIG. 31, in a liquid crystal panel 100Z2, like the liquid crystal panel 100Z1 shown in FIG. 30, subpixels 103Z are arranged in a matrix; unlike the liquid crystal panel 100Z1, in addition to the red (R), green (G), and blue (B) subpixels 103Z, a white (W) subpixel 103Z is provided.

Specifically, the subpixels 103Z of four different colors, namely white (W), red (R), green (G), and blue (B), are arranged in rows in this order in such a way as to form a repeating pattern thereof, and the subpixels 103Z of the same color are arranged in columns. Adding a white (W) subpixel 103Z in this way helps achieve higher brightness. It is to be noted that FIG. 31 shows the polarities observed when dot inversion driving is performed.

Patent Document 1: JP-A-2003-295157
Patent Document 2: JP-A-H11-295717
Patent Document 3: JP-A-H10-10998
Patent Document 4: JP-A-H2-118521
Patent Document 5: JP-A-2004-78218
Patent Document 6: JP-A-2005-202377

DISCLOSURE OF THE INVENTION

Problems to be Solved by the Invention

Now, with respect to the aforementioned liquid crystal panel 100Z2, the following problem arises. When one color or a complementary color thereof is displayed with the liquid crystal panel 100Z2, a horizontal shadow (horizontal crosstalk) (see FIG. 34) occurs even if dot inversion driving is performed. Hereinafter, this problem will be described with reference to FIGS. 32 and 33.

FIGS. 32 and 33 deal with cases in which only red (R) is displayed with the liquid crystal panels 100Z1 and 100Z2, respectively. As shown in FIG. 32, when one color is displayed with the liquid crystal panel 100Z1 of three different colors, a subpixel 103Z having a polarity "+" and a subpixel 103Z having a polarity "−" are alternately arranged in rows. By contrast, as shown in FIG. 33, with the liquid crystal panel 100Z2 of four different colors, subpixels 103Z having the same polarity are arranged in rows.

As just described, when the subpixels 103Z having the same polarity are arranged in rows, a horizontal shadow occurs. This problem is not confined to four colors, but also occurs in a case where an even number of colors are used.

In view of the conventionally experienced problem described above, it is an object of the present invention to provide display devices and methods for driving a display member, the display devices and methods that can reduce the shadow (crosstalk) described above.

Means for Solving the Problem

To achieve the above object, according to one aspect of the present invention, a display device is provided with: a display member including a plurality of subpixels of P (P is an even number equal to or larger than 4) different colors, the plurality of subpixels being two-dimensionally arranged in a display area, and a plurality of signal lines connected to the plurality of subpixels; and a drive device including a driver connected to the plurality of signal lines, the driver outputting a first signal and a second signal as a drive signal to be applied to each signal line, the first and second signals being opposite to each other in polarity. The plurality of signal lines are arranged in the display area in a first direction, and each extend in a second direction in the display area, the first direction and the second direction intersecting at right angles. If the plurality of signal lines are divided into a plurality of signal line groups, each being composed of Q (Q is a positive integer multiple of P) consecutive signal lines in the display area, the plurality of subpixels are two-dimensionally arranged in such a way that a sequence of subpixels of P different colors is repeated in the first direction, whereby the subpixels of the same color are each connected to an s-th (s is a positive integer between 1 and Q inclusive) signal line of each signal line group. The display device is so structured that, if the first signal is applied to the s-th signal line of an odd-numbered signal line group in the display area, the second signal is applied to the s-th signal line of an even-numbered signal line group in the display area, and that the first signal and the second signal are each applied to a corresponding one of the signal lines of each signal line group, the signal lines being adjacent to each other in the display area.

Additionally, another aspect of the present invention is directed to a method of driving a display member including a plurality of subpixels of P (P is an even number equal to or larger than 4) different colors, the plurality of subpixels being two-dimensionally arranged in a display area, and a plurality of signal lines connected to the plurality of subpixels. The plurality of signal lines are arranged in the display area in a first direction, and each extend in a second direction, the first direction and the second direction intersecting at right angles. If the plurality of signal lines are divided into a plurality of signal line groups, each being composed of Q (Q is a positive integer multiple of P) consecutive signal lines in the display area, the plurality of subpixels are two-dimensionally arranged in such a way that a sequence of subpixels of P different colors is repeated in the first direction, whereby the subpixels of the same color are each connected to an s-th (s is a positive integer between 1 and Q inclusive) signal line of each signal line group. In the driving method, if the first signal is applied to the s-th signal line of an odd-numbered signal line group in the display area, the second signal is applied to the s-th signal line of an even-numbered signal line group in the display area, and the first signal and the second signal are each applied to a corresponding one of the signal lines of each signal line group, the signal lines being adjacent to each other in the display area.

Advantages of the Invention

According to this structure, it is possible to make the polarity of (the potential of the subpixel electrode of) a subpixel of one color, the subpixel being arranged in a first direction and connected to an odd-numbered signal line group, different from the polarity of another subpixel of the same color, the subpixel being arranged in the first direction and connected to an even-numbered signal line group. This helps reduce a shadow (crosstalk) in the first direction.

LIST OF REFERENCE SYMBOLS

10A to 10C, 10F Display device
100A to 100F Liquid crystal panel (Display member)
101 Display area
102 Non-display area
103 Subpixel
104 Pixel
112 Signal line
112A Signal line group
200 Drive device
210A, 210B Source driver (Driver)
212 Individual driver
212A Individual driver group
300 Backlight device
D1 First direction
D2 Second direction
S12 Drive signal (First signal, Second signal)
CK1 Clock signal (First clock)
CK2 Clock signal (Second clock)
DA1 First parallel data strings
DA2_L, DA2_2L Second parallel data strings
DA3 Third parallel data strings
DA4_L, DA4_2L, DA4_3L Fourth parallel data strings
DA5 Fifth parallel data strings
X, Y, Z, XC, YC, ZC, XS, YS, ZS Data (Data string)
W0, R0, G0, B0 Data (Data string)

BEST MODE FOR CARRYING OUT THE INVENTION

Figure 1:
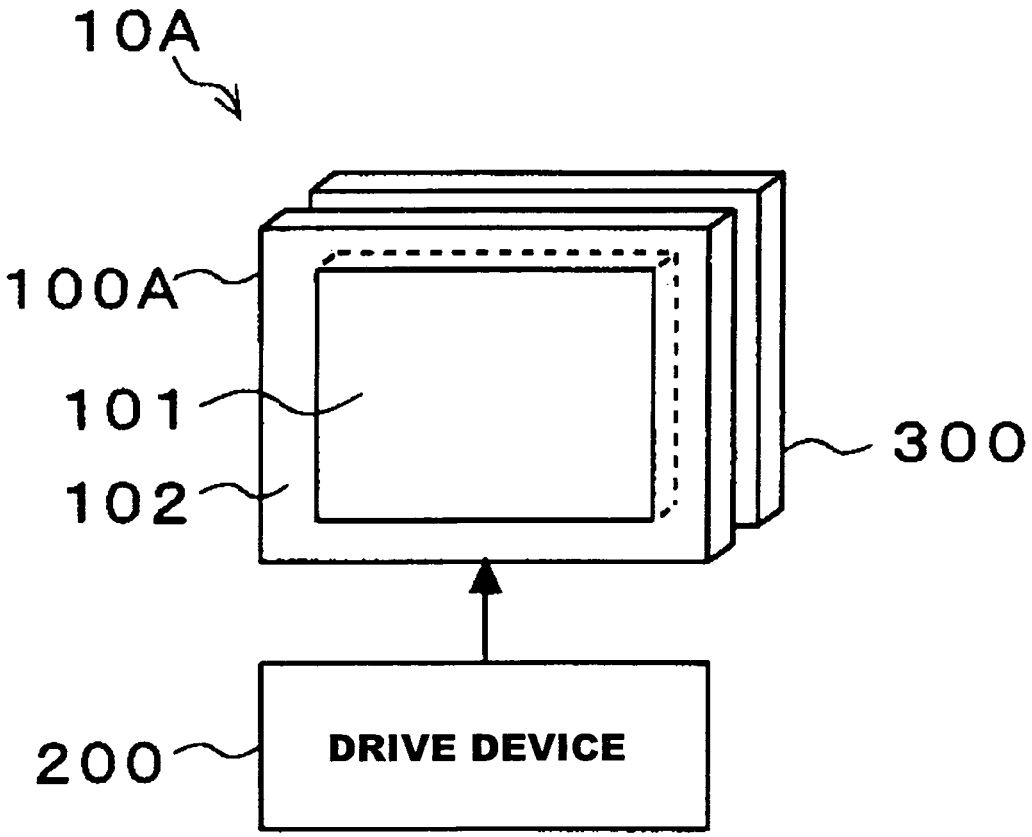
FIG. 1 A schematic diagram for illustrating a display device according to a first embodiment of the invention.
Figure 2:
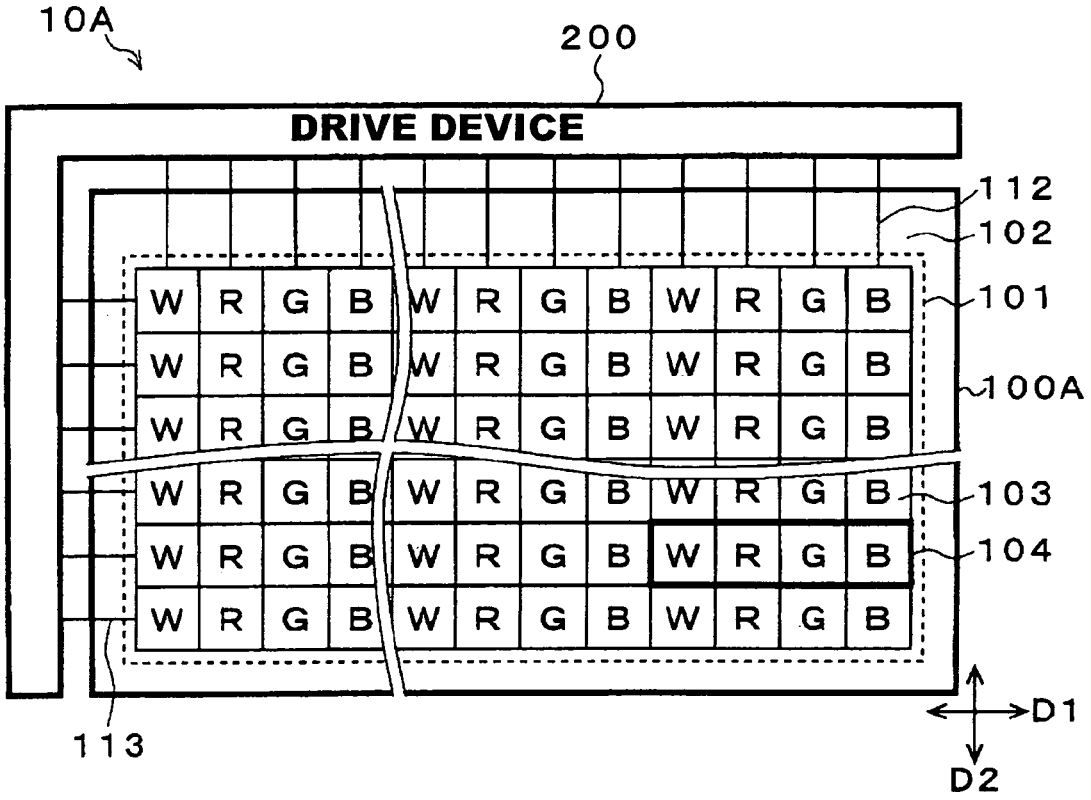
FIG. 2 A schematic diagram for illustrating the display device according to the first embodiment of the invention.

FIGS. 1 and 2 are each a schematic diagram for illustrating a display device 10A according to a first embodiment. The display device 10A includes a liquid crystal panel 100A as a display member, a drive device 200 for the liquid crystal panel 100A, and a backlight device 300 that is so disposed as to shine backlight on the liquid crystal panel 100A. The display device 10A is a so-called transmissive liquid crystal display device. It is to be noted that the backlight device 300 is not illustrated in FIG. 2 and others.

The liquid crystal panel 100A is broadly divided into a display area 101 in which subpixels 103 are arranged and a non-display area 102 corresponding to an area other than the display area 101. In the liquid crystal panel 100A, the non-display area 102 is provided in such a way as to surround the display area 101 as seen in a plan view of (the screen of) the liquid crystal panel 100A.

It should be understood that these areas 101 and 102 each cover not only a two-dimensional area as seen in a plan view of the liquid crystal panel 100A but also a three-dimensional area of the liquid crystal panel 100A, the three-dimensional area being obtained by projecting the two-dimensional area into a three-dimensional space in the direction of thickness of the liquid crystal panel 100A (in the direction in which substrates 110 and 130, which will be described later, are stacked (see FIG. 4)).

As shown in FIG. 2, each subpixel 103 displays one of four kinds of colors (that is, four different colors), namely white (W), red (R), green (G), and blue (B). It should be understood that, in the figures, "W" indicates that a display color of the subpixel 103 marked therewith is white, and similarly, "R", "G", and "B" indicate that display colors of the subpixels 103 marked therewith are red, green, and blue, respectively.

A plurality of subpixels 103 are two-dimensionally arranged in a matrix; in other words, they are arranged in a first direction D1 and in a second direction D2, the first direction D1 and the second direction D2 intersecting at right angles. Here, the first direction D1 corresponds to a direction of row (horizontal direction) of the screen of the liquid crystal panel 100A, and the second direction D2 corresponds to a direction of column (vertical direction) of the screen.

In the first direction D1, the white (W), red (R), green (G), and blue (B) subpixels 103 are arranged in this order in such a way as to form a repeating pattern thereof. That is, a sequence of subpixels 103 of four different colors are arranged in such a way that the same pattern is repeated.

In the second direction D2, the subpixels 103 of the same color are arranged. It should be noted that a sequence of subpixels 103 of four different colors arranged in the first direction D1 forms a pixel 104 which is the unit of color display, and, in FIG. 2, one pixel 104 is surrounded by a heavy line for purposes of illustration.

Figure 3:
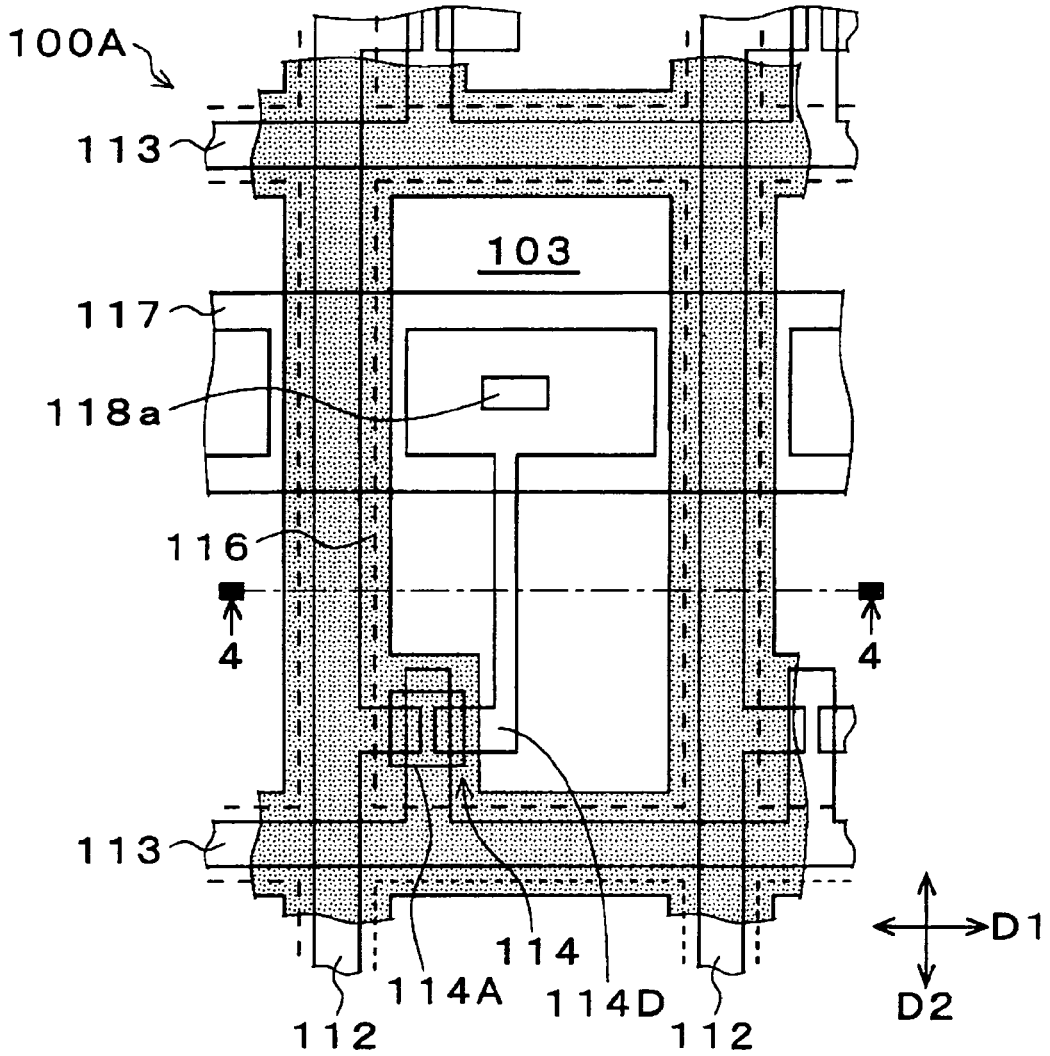
FIG. 3 A plan view (a layout diagram) for illustrating the liquid crystal panel according to the first embodiment of the invention.
Figure 4:
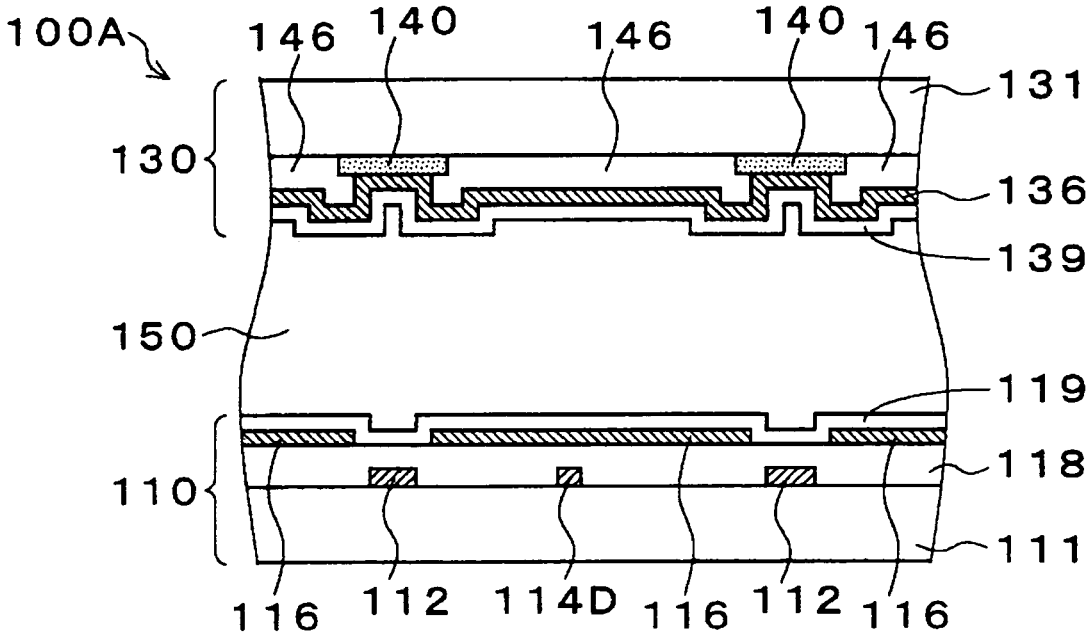
FIG. 4 A sectional view taken on the line 4-4 of FIG. 3.

Here, a plan view (a layout diagram) of the liquid crystal panel 100A is shown in FIG. 3, and a sectional view thereof taken on the line 4-4 of FIG. 3 is shown in FIG. 4. The liquid crystal panel 100A includes a TFT (thin film transistor) substrate 110, a counter substrate 130 that is so disposed as to face the TFT substrate 110, and a liquid crystal 150 sealed between the substrates 110 and 130. Incidentally, the "TFT substrate" is also called, for example, a TFT array substrate, an array substrate, an active substrate, a matrix substrate, and an active matrix substrate.

The TFT substrate 110 includes a transparent insulating substrate 111, a circuit layer formed on the substrate 111, and an alignment film 119 formed on the circuit layer.

The circuit layer includes a signal line 112, a scanning line 113, a TFT 114 (including a semiconductor layer 114A and a drain electrode 114D) serving as a switching device, a subpixel electrode 116, an auxiliary capacitance line 117, and an insulating layer 118 that insulates the above constituent elements 112, 113, 114A, 114D, 116, and 117 from one another in such a way that they form a given circuit.

In FIG. 3, for the sake of understandability, the subpixel electrode 116 is indicated by dashed lines. The "subpixel electrode" is also called, for example, a pixel electrode.

Specifically, each signal line 112 extends in the second direction D2 in the display area 101, and a plurality of signal lines 112 are arranged in the first direction D1 in the display area 101. A plurality of scanning lines 113 are formed in such a way that the scanning lines 113 and the signal lines 112 cross each other (cross each other at different levels).

That is, each scanning line 113 extends in the first direction D1 in the display area 101, and these scanning lines 113 are arranged in the second direction D2 in the display area 101. At each intersection of the signal line 112 and the scanning line 113, the TFT 114 is formed.

Near the intersection described above, a projection of the signal line 112 forms a source electrode of the TFT 114, and a projection of the scanning line 113 forms a gate electrode of the TFT 114. The semiconductor layer 114A is disposed so as to face the gate electrode. A portion of the insulating layer 118, the portion being laid between the semiconductor layer 114A and the gate electrode, forms a gate insulator.

To the semiconductor layer 114A, the projection of the signal line 112, the projection forming the source electrode, and the drain electrode 114D of the TFT 114 are electrically connected. As seen in a plan view, between the source electrode and the drain electrode 114D, the gate electrode is located.

The drain electrode 114D is so formed as to face the auxiliary capacitance line 117 disposed between the scanning lines 113 and extending in the first direction D1, and is connected to the subpixel electrode 116 via a through hole 118*a* of the insulating layer 118.

The subpixel electrodes 116 are disposed one in each of the areas separated by the signal lines 112 and the scanning lines 113 in such a way as to be adjacent to the signal lines 112 and the scanning lines 113. Each subpixel electrode 116 is disposed on the insulating layer 118, and the alignment film 119 is disposed on the insulating layer 118 in such a way as to cover the subpixel electrode 116.

On the other hand, the counter substrate 130 includes a transparent insulating substrate 131, a color filter 146, a light shielding layer 140, a transparent electrode 136, and an alignment film 139. The counter substrate including the color filter is also called, for example, a color filter substrate.

The color filter 146 is disposed on the transparent insulating substrate 131 in such a way as to face the subpixel electrode 116 of the aforementioned TFT substrate 110. The display color of each subpixel 103 depends on the color of the color filter 146 thereof.

That is, the color filter 146 colors the backlight emitted from the backlight device 300 (see FIG. 1), whereby the display colors of white (W), red (R), green (G), and blue (B) are obtained. It is to be noted that, if the color of the backlight is identical to the display color of white (W), no color filter 146 may be provided for the white (W) subpixel 103.

In the display area 101, the light shielding layer 140 is formed in the form of mesh in such a way as to pass between the adjacent color filters 146, in other words, to face (overlap with) the signal line 112 and the scanning line 113 of the TFT substrate 110.

In FIG. 3, for the sake of understandability, the light shielding layer 140 is hatched. The light shielding layer 140 is so formed as to overlap also with the TFT 114, and has, in the non-display area 102, a picture-flame shaped portion (not shown) surrounding the display area 101.

The transparent electrode 136 is so disposed as to cover the color filter 146 and the light shielding layer 140. The electrode 136 spreads over the display area 101. On the transparent electrode 136, the alignment film 139 is disposed.

The TFT substrate 110 and the counter substrate 130 are disposed in such a way that the alignment films 119 and 139 face each other. In a space between the substrates 110 and 130, the liquid crystal 150 is sealed. On the outer surfaces of the substrates 110 and 130, an unillustrated polarizing film is disposed. The backlight device 300 (see FIG. 1) is disposed in such a way that the backlight is shone onto the liquid crystal panel 100A on the TFT substrate 110 side thereof.

It is to be understood, however, that the configuration specifically shown in FIGS. 3 and 4 is given merely as an example. The TFT 114 may be replaced with a switching device of any other type, such as a MIM (metal insulator metal) device, and the color filter 146 may be provided on the side of the TFT substrate 110 (a so-called color filter on TFT substrate).

In the liquid crystal panel 100A described above, the subpixel 103 is composed of the subpixel electrode 116, the TFT 114, the color filter 146, and a portion of the transparent electrode 136, the portion facing the subpixel electrode 116.

Figure 5:
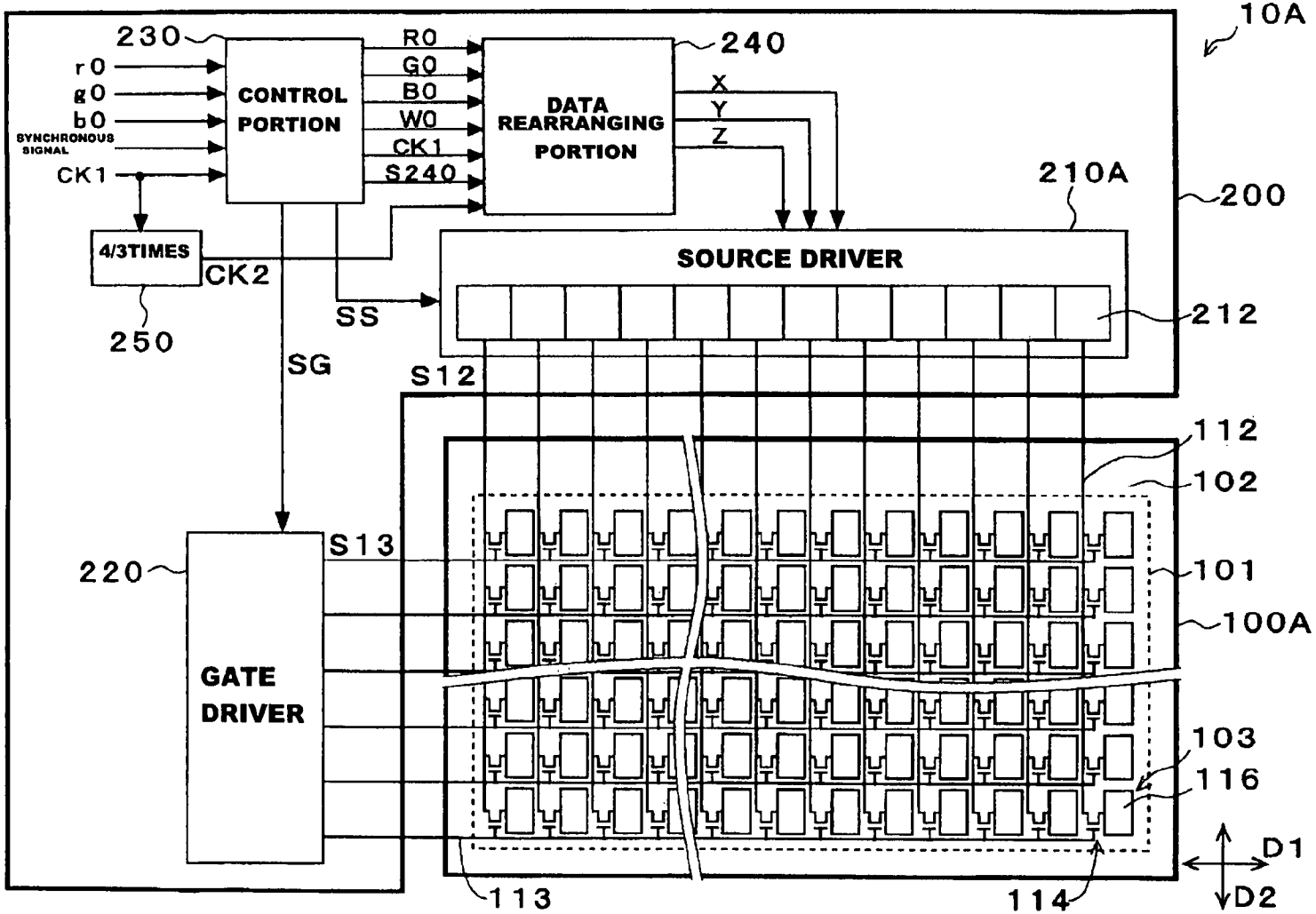
FIG. 5 A block diagram for illustrating the display device according to the first embodiment of the invention.

In this case, as shown in FIG. 5, in the first direction D1, the subpixel electrodes 116 are arranged alternating with the signal lines 112; in the second direction D2, they are arranged alternating with the scanning lines 113.

Each subpixel electrode 116 is connected to the nearest signal line 112 (in FIG. 5, to the signal line 112 on its left side) via the TFT 114, and the gate of the TFT 114 is connected to the nearest scanning line 113 (in FIG. 5, to the scanning line 113 on its lower side). With this connection relationship, each subpixel 103 is connected to the signal line 112 and the scanning line 113.

In this case, a plurality of subpixels 103 arranged in the second direction D2 are connected to one signal line 112, and a plurality of subpixels 103 arranged in the first direction D1 are connected to one scanning line 113. It is to be noted that, in FIG. 2, the above-described connection relationship between the subpixel electrode 116 and the signal line 112 and the scanning line 113 is simplified, and such simplification is adopted in the following figures.

As shown in FIGS. 2 and 5, in the liquid crystal panel 100A, the signal lines 112 and the scanning lines 113 further extend into the non-display area 102 while maintaining the arrangement sequence in the display area 101. The ends of the signal lines 112 and the scanning lines 113 located in the non-display area 102 serve as the input nodes of the liquid crystal panel 100A, and these input nodes are connected via wiring to the drive device 200.

As shown in FIG. 5, the drive device 200 includes a source driver 210A, a gate driver 220, a control portion 230, a data rearranging portion 240, and a 4/3 frequency multiplier (in the figure, "4/3 times") 250.

The source driver 210A outputs a drive signal S12 to be applied to each signal line 112, and includes a plurality of individual drivers 212 arranged in parallel. The individual drivers 212 are numbered, or the numerical sequence thereof is determined. In the figure, the individual drivers 212 are arranged in numerical sequence, and they are numbered 1, 2, . . . starting from the one nearest to the left side of the figure.

The output nodes of the individual drivers 212 are connected via the wiring to the signal lines 112 of the liquid crystal panel 100A. With this connection, the drive signals S12 outputted from the individual drivers 212 are applied to the signal lines 112. It is to be noted that the individual drivers 212 are provided one for each of the signal lines 112. The timing with which the drive signals S12 are outputted, for example, is controlled by a source driver control signal SS outputted from the control portion 230.

The gate driver 220 outputs a scanning signal S13 to be applied to each scanning line 113, and is connected via the wiring to the scanning lines 113 of the liquid crystal panel 100A. With this connection, the scanning signals S13 outputted from the gate driver 220 are applied to the scanning lines 113. The timing with which the scanning signals S13 are outputted, for example, is controlled by a gate driver control signal SG outputted from the control portion 230.

Figure 6:
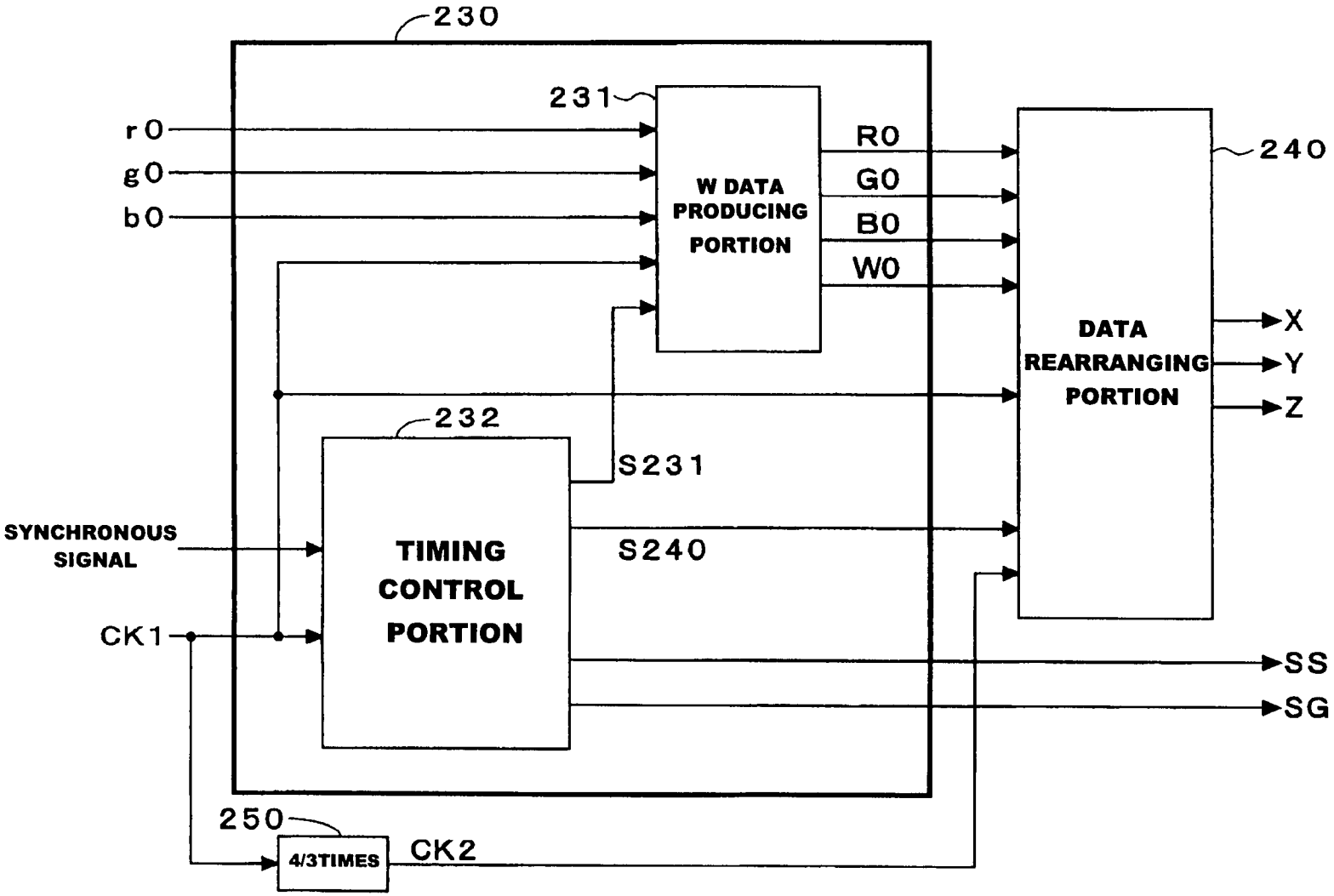
FIG. 6 A block diagram for illustrating the display device according to the first embodiment of the invention.

Here, FIG. 6 shows a more specific block diagram of the control portion 230. As shown in FIG. 6, the control portion 230 includes a W data producing portion 231 and a timing control portion 232.

The W data producing portion 231 obtains red (R), green (G), and blue (B) data r0, g0, and b0 of the display image and a clock signal (first clock) CK1, produces white (W) gray-scale data (gray-scale data string) W0 based on the obtained three-color data r0, g0, and b0, and then outputs the data thus produced.

In addition, the W data producing portion 231 converts the obtained three-color data r0, g0, and b0 to red (R), green (G), and blue (B) gray-scale data (gray-scale data strings) R0, G0, and B0, so as to make the three-color data r0, g0, and b0 suitable for the color display characteristics of the liquid crystal panel 100A, and outputs the data thus obtained.

On the other hand, the timing control portion 232 obtains a synchronous signal and a clock signal CK1, and, based on the synchronous signal thus obtained, produces a control signal SS for the source driver 210A and a control signal SG for the gate driver 220, and then outputs the produced signals.

In addition, the timing control portion 232 produces control signals S231 and S240 (trigger signals indicating, for example, the start and end of the operation) for the W data producing portion 231 and the data rearranging portion 240, respectively, and outputs the signals thus produced.

The data rearranging portion 240 obtains the data (data strings) R0, G0, B0, and W0, the clock signal CK1, and the control signal S240, rearranges the data R0, G0, B0, and W0 thus obtained into data (data strings) X, Y, and Z according to the input format of the source driver 210A, and outputs the resultant data to the source driver 210A.

At this point, the data rearranging portion 240 obtains a clock signal (second clock) CK2 produced by the 4/3 frequency multiplier 250 by multiplying the frequency of the clock signal CK1 by a factor of 4/3, and produces data X, Y, and Z based on the clock signal CK2 thus obtained, and outputs the produced data.

The source driver 210A sequentially receives the data X, Y, and Z. After having received all the data X, Y, and Z (in other words, data R0, G0, B0, and W0) for all the signal lines 112, the source driver 210A simultaneously applies the drive signals S12 one for each of the signal lines 112 in synchronism with the timing with which the gate driver 220 selects the scanning line 113.

Figure 7:
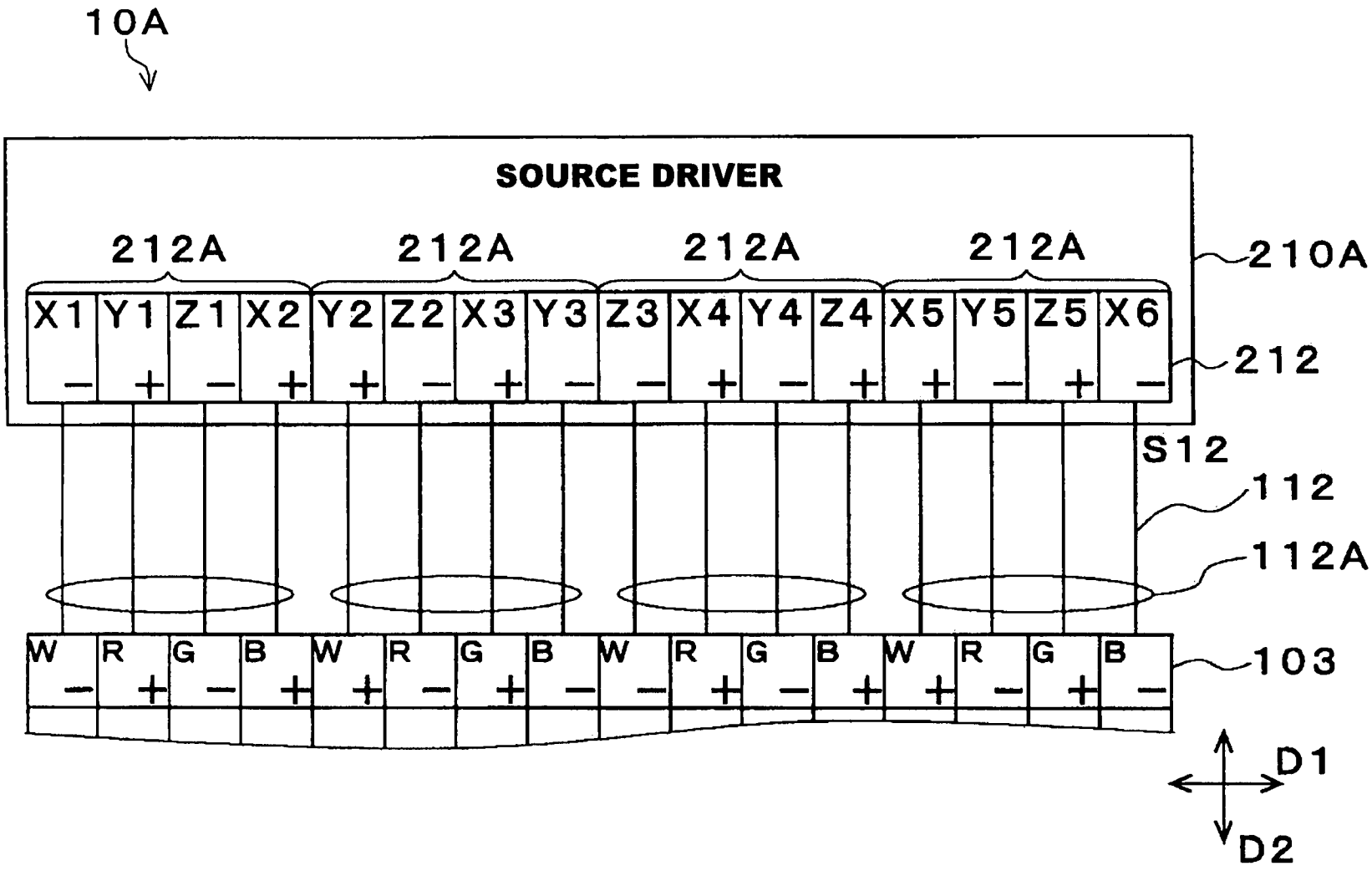
FIG. 7 A schematic diagram for illustrating the display device according to the first embodiment of the invention.

Here, with reference to FIGS. 7 and 8, processing performed by the data rearranging portion 240 in the display device 10A will be described more specifically. In FIG. 7, as indicated in the individual drivers 212, the individual drivers 212 receive, with the smallest number first (from the one, nearest to the left of the figure), the gray-scale data X1, Y1, Z1, X2, Y2, Z2, X3, Y3, Z3, X4, Y4, Z4, X5, Y5, Z5, and X6 in this order.

Here, the gray-scale data X1, X2, X3, X4, X5, and X6 is first to sixth data of the data string X, the gray-scale data Y1, Y2, Y3, Y4, and Y5 is first to fifth data of the data string Y, and the gray-scale data Z1, Z2, Z3, Z4, and Z5 is first to fifth data of the data string Z.

As described above, the data rearranging portion 240 receives the gray-scale data (data strings) W0, R0, G0, and B0 and the clock signal (first clock) CK1.

Figure 8:
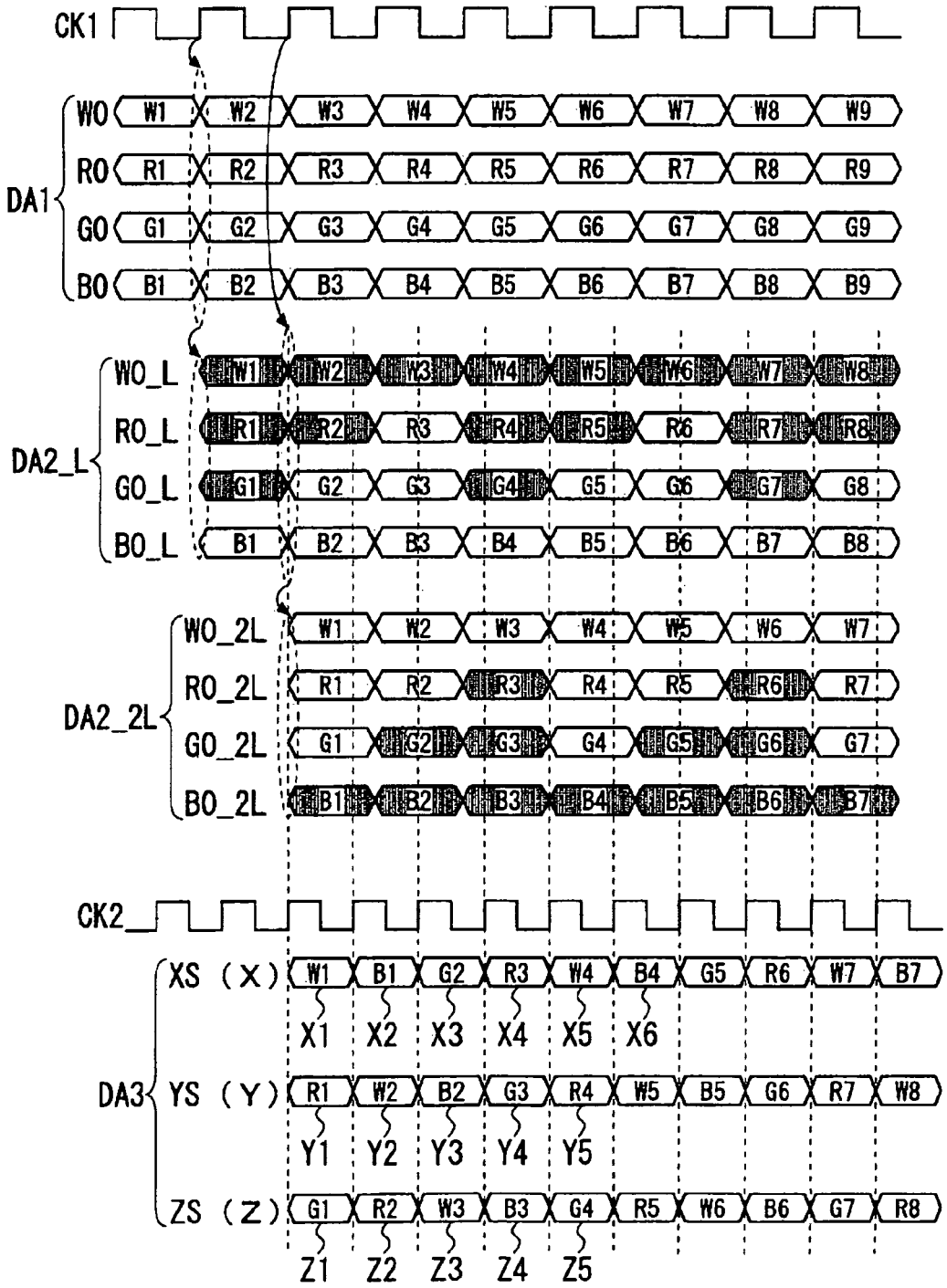
FIG. 8 A timing chart for explaining the display device according to the first embodiment of the invention.

In this case, as shown in FIG. 8, the gray-scale data string W0 is a data string composed of gray-scale data W1, W2, W3, . . . , each being synchronized with a rising edge of the clock signal CK1. The gray-scale data W1, W2, W3, . . . is data on the gray levels of the first, second, third, . . . white (W) subpixels 103 (in this example, from the left) of each row of the liquid crystal panel 100A.

The gray-scale data strings R0, G0, and B0 are strings of data on the gray levels of the red (R), green (G), and blue (B) subpixels 103. The gray-scale data strings R0, G0, and B0 have the same data structure as that of the aforementioned gray-scale data string W0.

Incidentally, four pieces of gray-scale data W1, R1, G1, and B1, for example, form display data for one pixel 104. These gray-scale data strings W0, R0, G0, and B0 of different colors are transmitted in parallel from the control portion 230 in synchronism with the clock signal CK1. As a result, the data rearranging portion 240 receives parallel data strings (first parallel data strings) DA1 composed of four data strings W0, R0, G0, and B0.

After receiving data, the data rearranging portion 240 applies a delay of one cycle of the clock signal CK1 and a delay of two cycles thereof to the parallel data strings DA1 in synchronism with the clock signal CK1, thereby producing two parallel data strings (second parallel data strings) DA2_L and DA2_2L, respectively.

Here, the parallel data strings DA2_L are composed of data strings W0_L, R0_L, G0_L, and B0_L obtained by applying a delay of one cycle to the data strings W0, R0, G0, and B0, and the parallel data strings DA2_2L are composed of data strings W0_2L, R0_2L, G0_2L, and B0_2L obtained by applying a delay of two cycles to the data strings W0, R0, G0, and B0. Incidentally, such a delay can be applied by a latch circuit, for example.

The data rearranging portion 240 samples three pieces of data in parallel from the two parallel data strings DA2_L and DA2_2L. This sampling is performed in synchronism with a rising edge of the clock signal (second clock) CK2 having a frequency 4/3 times as high as that of the clock signal CK1. In addition, this sampling is performed in the order in which different colors are arranged in the first direction D1 in the display area 101.

Specifically, as shown in FIG. 8, three pieces of data W1, R1, and G1 (in the figure, they are hatched for the sake of clarity; the same goes for other sampled data) are first sampled from the two parallel data strings DA2_L and DA2_2L.

These sampled pieces of gray-scale data W1, R1, and G1 are the gray-scale data of the first, second, and third subpixels (from the left) of each row of the liquid crystal panel 100A, respectively, the first subpixel 103 being of white (W), the second subpixel 103 being of red (R), and the third subpixel 103 being of green (G) (see FIG. 7).

That is, three pieces of data W1, R1, and G1 are sampled in the order in which different colors are arranged in the first direction D1 in the display area 101.

Thereafter, as shown in FIG. 8, another three pieces of data B1, W2, and R2 are sampled at the next rising edge of the clock signal CK2. These sampled pieces of gray-scale data B1, W2, and R2 are the gray-scale data of the fourth to sixth subpixels 103 of each row of the liquid crystal panel 100A, respectively, the fourth subpixel 103 being of blue (B), the fifth subpixel 103 being of white (W), and the sixth subpixel 103 being of red (R) (see FIG. 7).

That is, sampling of the data W1, R1, and G1 is followed by sampling of next three pieces of data B1, W2, and R2 performed in the order in which different colors are arranged in the first direction D1 in the display area 101. Sampling is continuously performed in the same manner as described above. Incidentally, this sampling can be performed with a logic circuit or a so-called microprocessor, for example.

Then, the data rearranging portion 240 produces parallel data strings (third parallel data strings) DA3 composed of three data strings XS, YS, and ZS from the sequentially sampled data. Specifically, the sequentially sampled data W1, B1, G2, R3, W4, B4, are arranged in series to produce the data string XS; the sequentially sampled data R1, W2, B2, G3, R4, . . . are arranged in series to produce the data string YS; and the sequentially sampled data G1, R2, W3, B3, G4 . . . are arranged in series to produce the data string ZS.

Incidentally, the data W1, B1, G2, R3, W4, B4, forming the data string XS are the gray-scale data of the subpixels 103 that appear at intervals of two subpixels; the data such as R1 forming the data string YS and the data such as G1 forming the data string ZS have the same data structure as that just described. The data rearranging portion 240 outputs the three data strings XS, YS, and ZS as the aforementioned gray-scale data X, Y, and Z.

Based on the received data strings XS, YS, and ZS, the source driver 210A produces the drive signals S12. That is, the source driver 210A receives the gray-scale data W1, B1, G2, R3, W4, and B4 of the data string XS (that is, the data string X) in this order as gray-scale data X1, X2, X3, X4, X5, and X6, and feeds them to the first, fourth, seventh, tenth, thirteenth, and sixteenth individual drivers 212, respectively (see FIGS. 7 and 8).

Similarly, the source driver 210A receives the gray-scale data R1, W2, B2, G3, and R4 of the data string YS (that is, the data string Y) in this order as gray-scale data Y1, Y2, Y3, Y4, and Y5, and feeds them to the second, fifth, eighth, eleventh, and fourteenth individual drivers 212, respectively.

Similarly, the source driver 210A receives the gray-scale data G1, R2, W3, B3, and G4 of the data string ZS (that is, the data string Z) in this order as the gray-scale data Z1, Z2, Z3, Z4, and Z5, and feeds them to the third, sixth, ninth, twelfth, and fifteenth individual drivers 212, respectively.

In this way, the data rearranging portion 240 rearranges the data of the four data strings W0, R0, G0, and B0 by performing the above-described sampling, and thereby produces three data strings XS, YS, and ZS.

Figure 30:
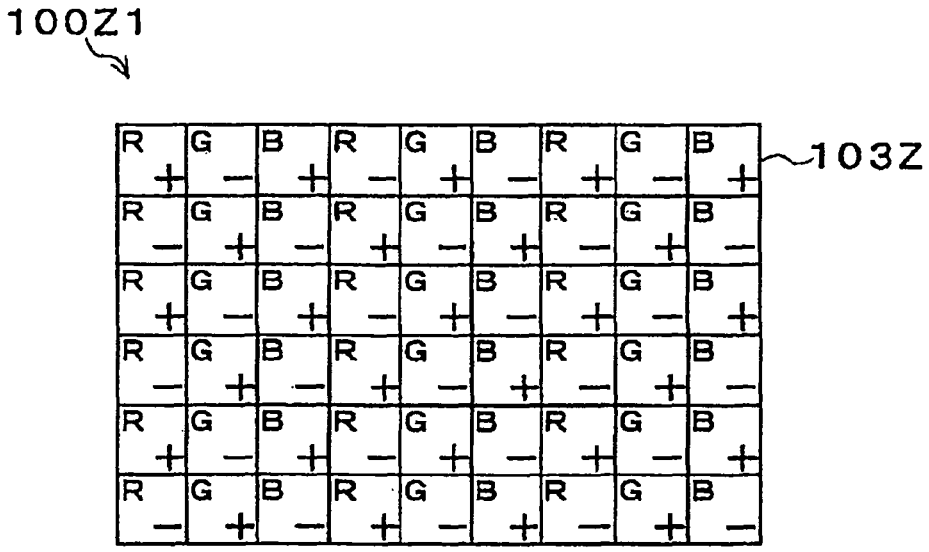
FIG. 30 A schematic diagram for explaining a conventional driving method (Example 1) of the liquid crystal panel.

That is, with this rearrangement, the data rearranging portion 240 reduces the number of data strings inputted thereto, and outputs the resultant data strings. In doing so, by converting the data strings into three data strings X, Y, and Z in the manner as described above, it is possible to use, as the source driver 210A, a commonly used three-input (RGB input) source driver, that is, a general-purpose source driver for a three-color liquid crystal panel (see the liquid crystal panel 100Z1 shown in FIG. 30).

That is, it is possible to drive four-color liquid crystal panel 100A with a general-purpose source driver for a three-color liquid crystal panel. Using the general-purpose driver helps achieve the cost reduction of the source driver 210A and the display device 10A.

The individual drivers 212 output the gray-scale data X1, Y1, Z1 and the like, that has been received in the manner as described above, as a "+(plus or positive)" drive signal S12 or a "–(minus or negative)" drive signal S12. This selection of polarity is controlled by the individual drivers 212.

It is to be noted that, when a "+" drive signal S12 is referred to as a "first signal", a "–" drive signal S12 having a polarity opposite thereto is a "second signal"; when a "–" drive signal S12 is referred to as a "first signal", a "+" drive signal S12 is a "second signal".

The drive signals S12 (in other words, the gray-scale data R0, G0, B0, and W0) are applied to the subpixel electrodes 116 via the TFTs 114 connected to the signal lines 112 and the selected scanning lines 113, and accordingly are fed to the subpixels 103. Each subpixel electrode 116 is fed with a voltage (potential) having the magnitude and polarity "+" or "–" according to the gray-scale data R0, G0, B0 or W0, and maintains the voltage thus fed until the next signal is applied.

Therefore, the polarity of each subpixel 103 is represented by the polarity of the voltage applied to the subpixel electrode 116 thereof. For example, the subpixel 103 marked with symbol "+" indicates that the subpixel electrode 116 thereof has a polarity "+". Incidentally, the polarity of the drive signal S12, the subpixel electrode 116, and the subpixel 103 is determined based on the potential of the transparent electrode 136.

Here, the aforementioned polarity of the drive signal S12 applied to each signal line 112 will be described with reference to the schematic diagrams of FIGS. 9 and 10. It is to be noted that FIG. 10 illustrates a case in which only red (R) is displayed. In these figures, the display color (white (W), red (R), green (G), or blue (B)) of each subpixel 103 is indicated on the upper left corner thereof, and an example of the polarity thereof is indicated on the lower right corner thereof. To make the explanation clear, the following description deals with a case in which the subpixels 103 are arranged to form 6 rows and 16 columns, the number of signal lines 112 is 16, and the number of individual drivers 212 is 16.

In this case, suppose that the signal lines 112 are divided into signal line groups 112A, each being composed of four consecutive signal lines 112 in the display area 101.

Then, the white (W) subpixels 103 are each connected to the first signal line 112 (in this case, the first signal line 112 from the left of the figure) of each signal line group 112A. Likewise, the red (R), green (G), and blue (B) subpixels 103 are connected to the second, third, and fourth signal lines 112, respectively, of each signal line group 112A. Incidentally, the same goes for the connection relationship of each row of the liquid crystal panel 100A.

Similarly, suppose that the individual drivers 212 are divided into individual driver groups 212A, each being composed of four consecutive individual drivers 212 (that is, as many individual drivers 212 as the signal lines 112 forming each signal line group 112A). Then, the individual driver groups 212A are provided one for each of the signal line groups 112A.

At this point, as described earlier, in the liquid crystal panel 100A, since the signal lines 112 further extend into the non-display area 102 while maintaining the arrangement sequence in the display area 101, the first individual driver 212 (in this case, the first individual driver 212 from the left of the figure) is connected, in the non-display area 102, via the wiring to a given signal line 112 which is the first in the non-display area 102. This signal line 112 is the first, too, in the display area 101.

As a result, the first individual driver 212 of each individual driver group 212A outputs the drive signal S12 for the white (W) subpixel 103. Likewise, the second to fourth individual drivers 212 of each individual driver group 212A are connected, respectively, to the second to fourth signal lines 112 in the non-display area 102 and the display area 101, and output the drive signals S12 for the red (R), green (G), and blue (B) subpixels 103, respectively.

In the figures, a letter on the upper left corner of each individual driver 212 indicates the color for which it outputs the drive signal S112, and a symbol on the lower right corner thereof indicates an example of the polarity of the drive signal S12 outputted therefrom.

Figure 9:
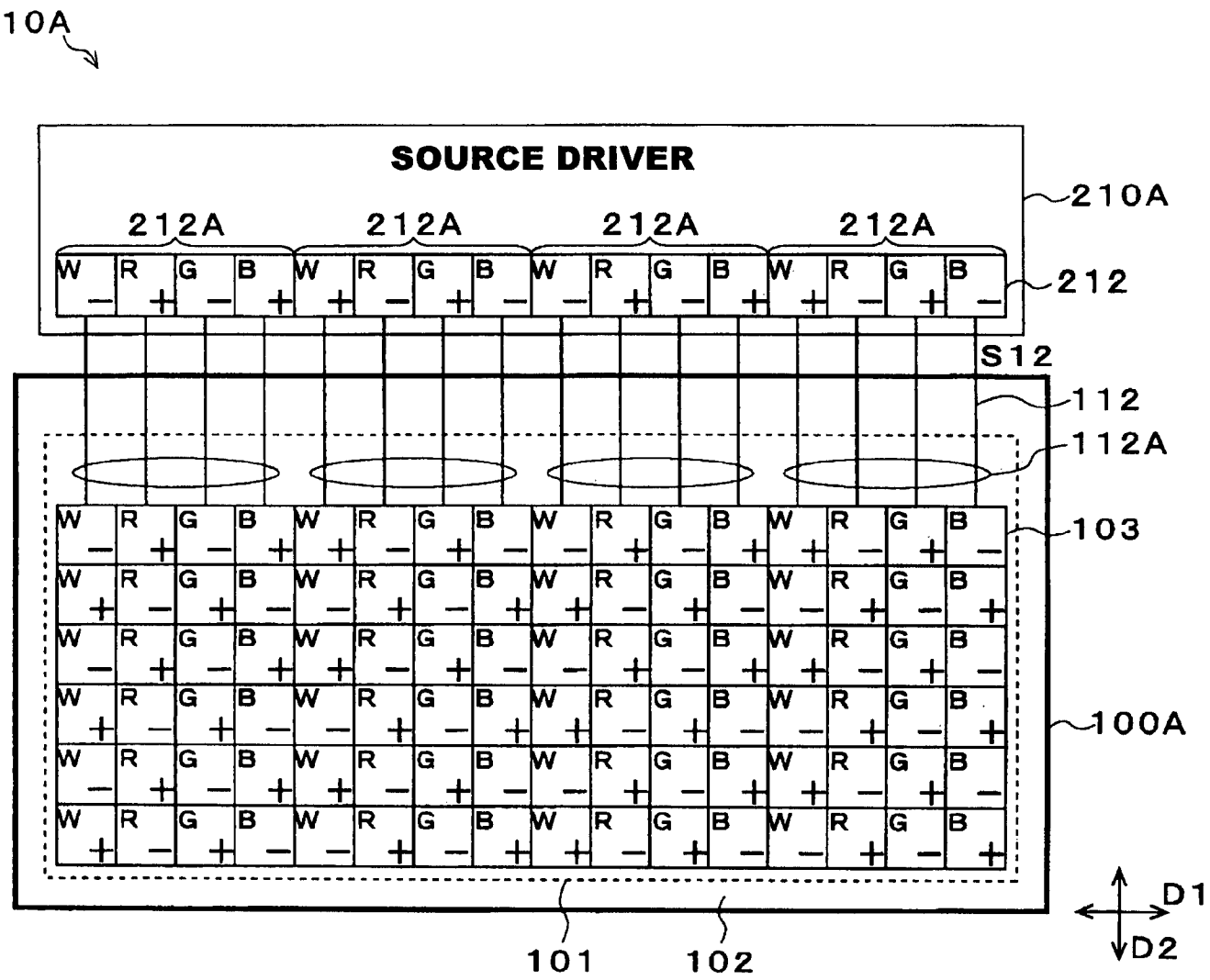
FIG. 9 A schematic diagram for illustrating the display device according to the first embodiment of the invention.
Figure 10:
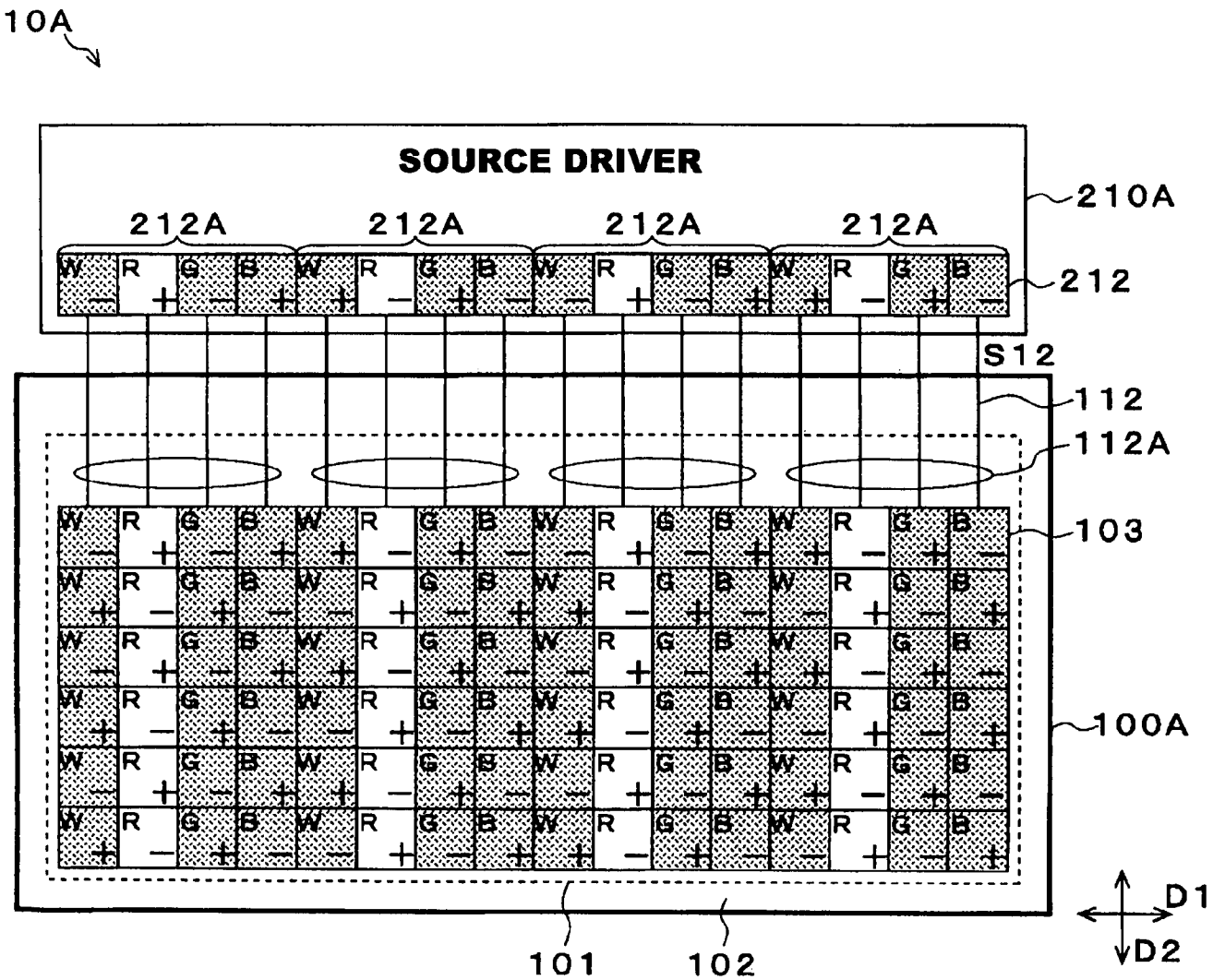
FIG. 10 A schematic diagram for illustrating the display device according to the first embodiment of the invention.

As illustrated in FIG. 9, the source driver 210A is so configured that, when the first individual drivers 212 of the first and third individual driver groups 212A, namely the odd-numbered individual driver groups 212A, output the "–" (or "+") drive signals S12, the first individual drivers 212 of the second and fourth individual driver groups 212A, namely the even-numbered individual driver groups 212A, output the "+" (or "–") drive signals S112.

Furthermore, the source driver 210A is so configured that two adjacent individual drivers 212 in each individual driver group 212A output the drive signals S112 of opposite polarity.

With consideration given to the fact that the individual drivers 212 are numbered in the manner as described above, and the individual drivers 212 shown in the figures are arranged in the numerical sequence, the individual drivers 212 that are numbered consecutively (in consecutive order) will be described as the "adjacent individual drivers 212".

Therefore, in the display device 10A, when the "+" (or "–") drive signal S12 is applied to the s-th (s is a positive integer between 1 and 4 inclusive) signal line 112 of the odd-numbered signal line group 112A in the display area 101, the "–" (or "+") drive signal S12 is applied to the s-th signal line 112 of the even-numbered signal line group 112A in the display area 101.

Moreover, in the display device 10A, the drive signals S12 of opposite polarity are applied to the adjacent signal lines 112 in each signal line group 112A.

As a result, according to the display device 10A and the driving method of the liquid crystal panel 100A of the display device 10A, it is possible to make the polarity of the subpixel 103 of one color, the subpixel 103 being arranged in the first direction D1 and connected to the odd-numbered signal line group 112A, different from the polarity of the subpixel 103 of the same color, the subpixel 103 being arranged in the first direction D1 and connected to the even-numbered signal line group 112A.

The descriptions heretofore deal with a case in which, since the even-numbered signal line groups 112A and the odd-numbered signal line groups 112A are equal in number, the "+" and "–" subpixels 103 of the same color are present (distributed) in a mixed manner in the first direction D1 at a ratio of 1:1. As described above, it is possible to make the subpixels 103 of the same color, the subpixels 103 being arranged in the first direction D1, namely in the horizontal direction, have different polarities. This helps reduce a horizontal shadow (horizontal crosstalk).

In the example shown in FIG. 9, the individual drivers 212 are each so configured as to output the "+" and "–" drive signals S12 alternately, such that 6 rows by 4 columns of subpixels 103 connected to each signal line group 112A are driven by so-called dot inversion driving. Incidentally, the above explanation holds true for a case in which the polarities of the drive signals S12 and the subpixels 103 shown in FIG. 9 are reversed.

Figure 11:
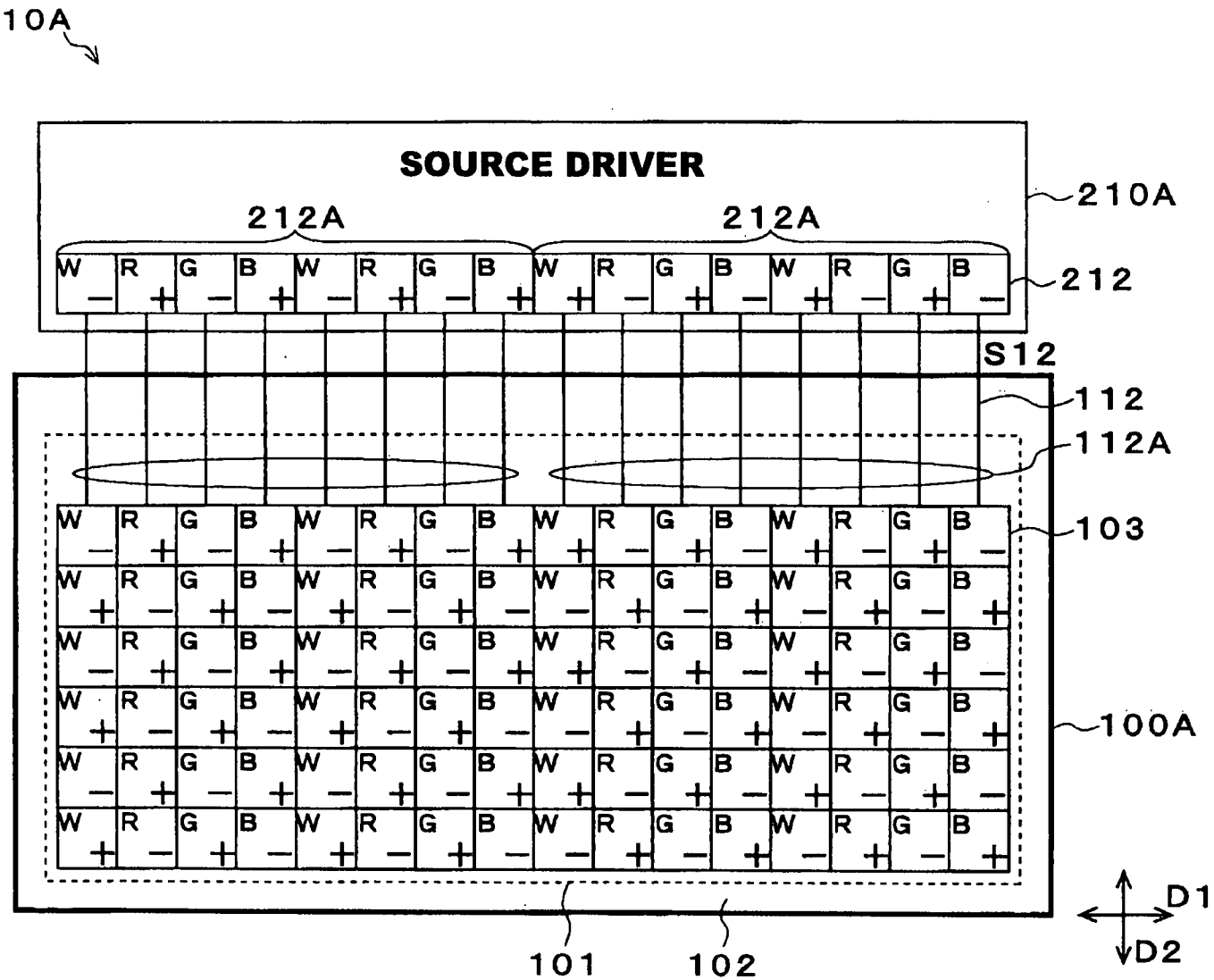
FIG. 11 A schematic diagram for illustrating the display device according to the first embodiment of the invention.

Here, the above-described configuration may be applied to a case in which, as shown in a schematic diagram shown in FIG. 11, each signal line group 112A is composed of eight consecutive signal lines in the display area 101, and each individual driver group 212A is composed of eight consecutive individual drivers. Alternatively, the above-described configuration may be applied to a case in which each signal line group 112A and each individual driver group 212A are composed of signal lines and individual drivers, respectively, whose number is a positive integer multiple of the number of colors (in this example, 4) of the subpixel 103. In either case, the above-described effects can be obtained.

In a case where each signal line group 112A is composed of four signal lines, that is, in a case where the number of colors of the subpixel 103 is equal to the number of signal lines 112 of each signal line group 112A, the largest number of signal line groups 112A are obtained. As a result, in this case, it is possible to distribute the subpixels 103 of opposite polarity and of the same color most widely in the first direction D1, namely in the horizontal direction. This helps greatly enhance the above-described effect of reducing a horizontal shadow.

Figure 12:
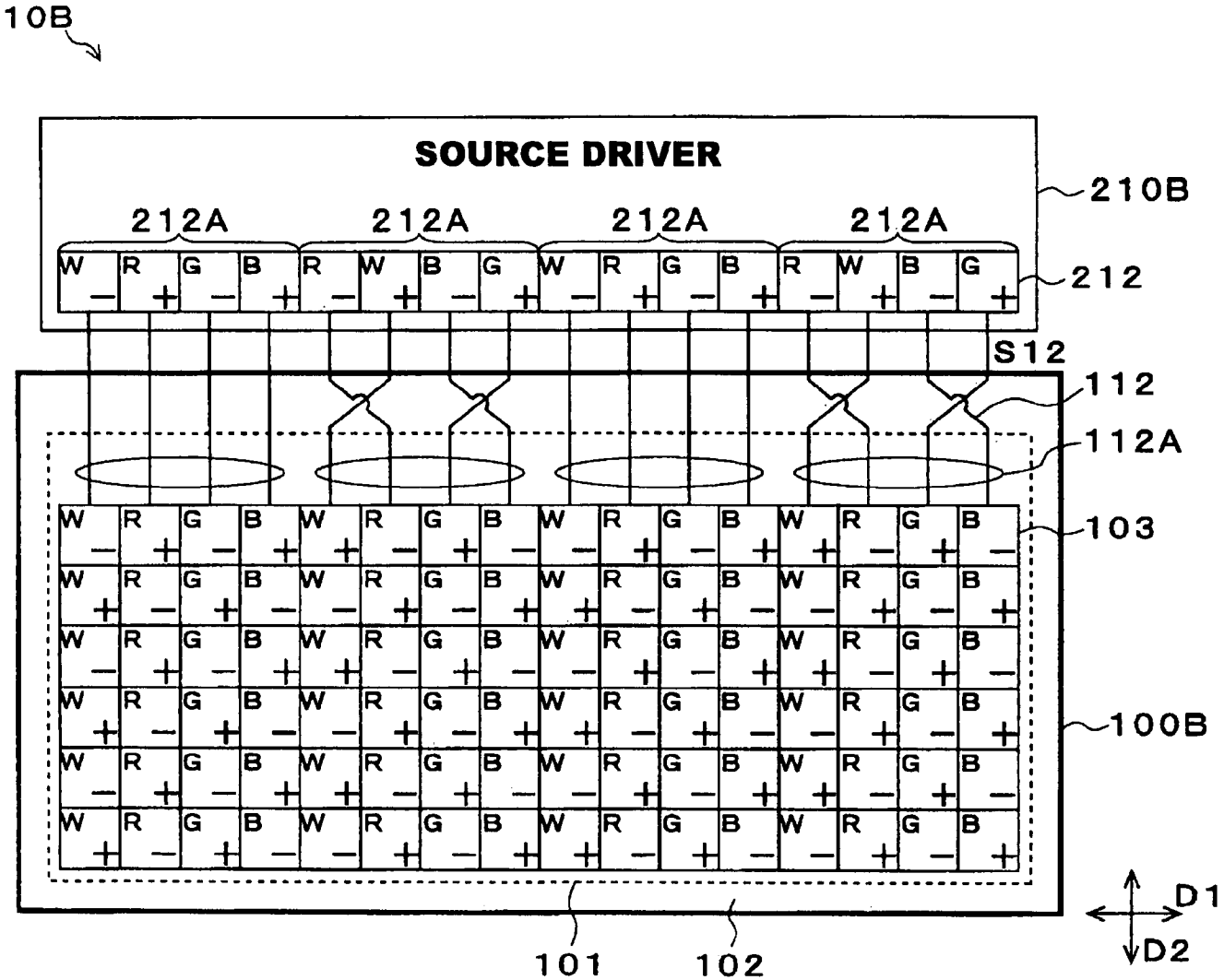
FIG. 12 A schematic diagram for illustrating a display device according to a second embodiment of the invention.
Figure 13:
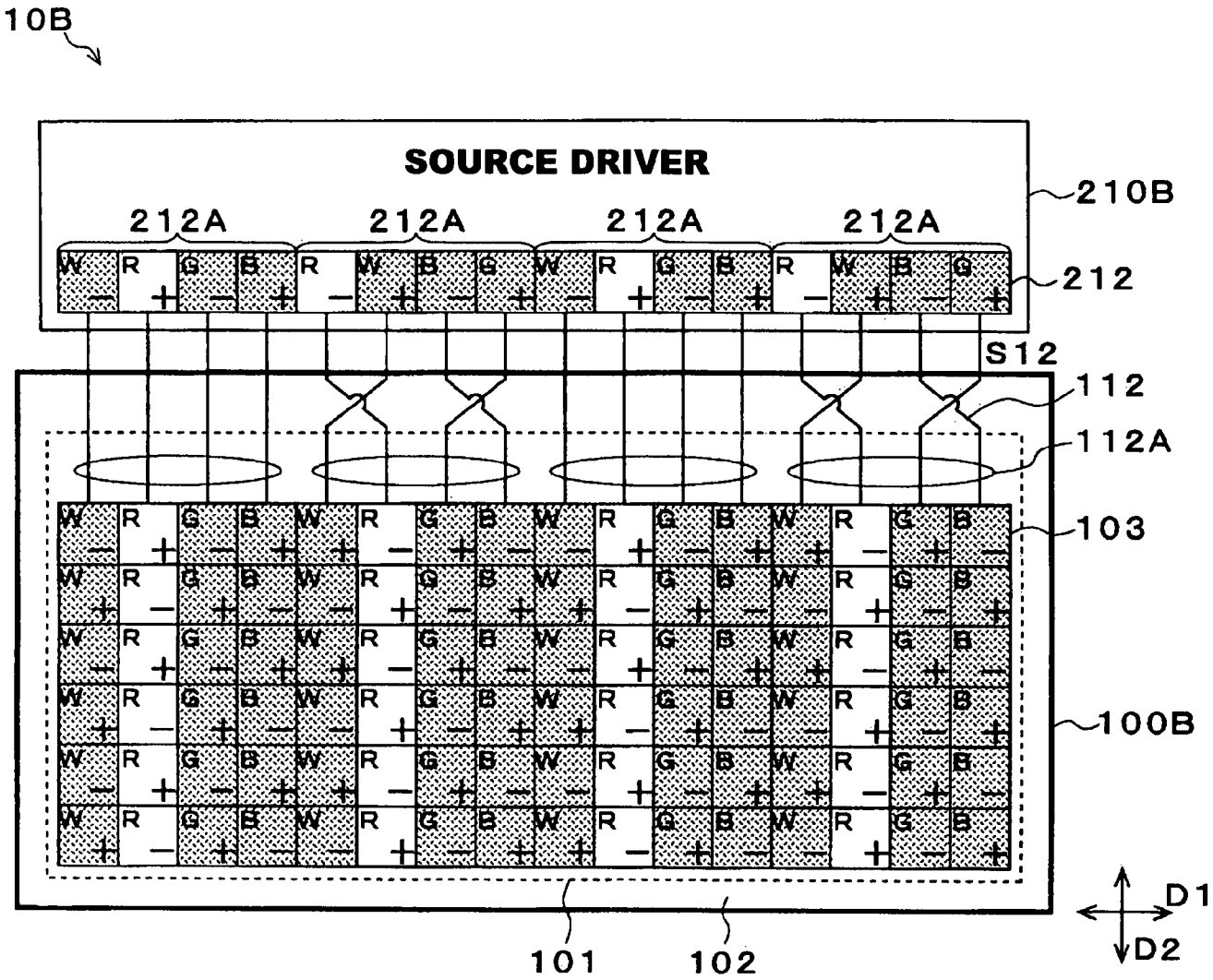
FIG. 13 A schematic diagram for illustrating the display device according to the second embodiment of the invention.

Next, schematic diagrams for illustrating a display device 10B of a second embodiment are shown in FIGS. 12 and 13. It is to be noted that FIG. 13 illustrates a case in which only red (R) is displayed. As shown in FIGS. 12 and 13, the display device 10B differs from the above-described display device 10 in that the liquid crystal panel 100A and the source driver 210A are replaced with a liquid crystal panel 100B and a source driver 210B. In other respects, the structure of the display device 10B is basically the same as that of the display device 10A.

First, the liquid crystal panel 100B differs from the above-described liquid crystal panel 100A (see FIG. 9) in the arrangement of the signal lines 112 in the non-display area 102. In other respects, the structure of the liquid crystal panel 100B is basically the same as that of the liquid crystal panel 100A.

The following description deals with a case in which, in the liquid crystal panel 100B, the signal lines 112 are divided into signal line groups 112A, each being composed of four consecutive signal lines 112 in the display area 101. In this case, in each of the second and fourth even-numbered signal line groups 112A, the first signal line 112 in the display area 101 becomes the second signal line 112 in the non-display area 102, and the second signal line 112 in the display area 101 becomes the first signal line 112 in the non-display area 102.

Likewise, the arrangement sequence of the third and fourth signal lines 112 in the display area 101 is reversed in the non-display area 102. In other words, if the first and second signal lines 112 in the display area 101 are considered to be a pair of signal lines 112, this pair of signal lines 112 further extends into the non-display area 102 with the arrangement sequence thereof reversed.

Likewise, the arrangement sequence of a pair of third and fourth signal lines 112 in the display area 101 is reversed in the non-display area 102. It is to be noted that the arrangement sequence of each pair (in each pair) is reversed.

Such a reversal of arrangement sequence is made possible by making the signal lines 112 cross each other (cross each other at different levels) in the insulating layer 118 (see FIG. 4) in the non-display area 102 (hence in the liquid crystal panel 100B). It is to be noted that the liquid crystal panel 100B is described as a "cross wiring type" and the liquid crystal panel 100A is described as a "straight wiring type".

The end of the first signal line 112 in the non-display area 102 is connected via the wiring to the first individual driver 212 of the source driver 210B. Similarly, the ends of the second to sixteenth signal lines 112 in the non-display area 102 are respectively connected to the second to sixteenth individual drivers 212 of the source driver 210B.

The individual drivers 212 of the source driver 210B differ from those of the above-described source driver 210A in the polarities of the drive signals S12 and the display colors to which they are assigned. Specifically, the source driver 210B is so configured that, when the odd-numbered individual drivers 212 output the "−" (or "+") drive signals S12, the even-numbered individual drivers 212 output "+" (or "−") drive signals S112.

That is, with this configuration, irrespective of the individual driver groups 212A, two adjacent individual drivers 212 are made to output the drive signals S12 of opposite polarity.

Furthermore, as described above, the arrangement sequence of the signal lines 112 is reversed in the even-numbered signal line group 112A. As a result of this reversal of arrangement sequence, the first to fourth individual drivers 212 of the even-numbered individual driver group 212A output the drive signals S12 for the red (R), white (W), blue (B), and green (G) subpixels 103, respectively. Incidentally, the odd-numbered individual driver groups 212A operate in basically the same manner as those of the above-described source driver 210A.

As described above, as a result of a reversal of the arrangement sequence of the signal lines 112, the color of the subpixel 103 handled by each individual driver 212 of the even-numbered individual driver group 212A is different from that of the above-described source driver 210A (see FIG. 9).

Therefore, the data rearranging portion 240 of the display device 10B performs appropriate processing for the source driver 210B and the liquid crystal panel 100B. Hereinafter, with reference to FIGS. 14 and 15 as well as to FIGS. 5 and 6 described above, processing performed by the data rearranging portion 240 in the display device 10B will be described.

Figure 14:
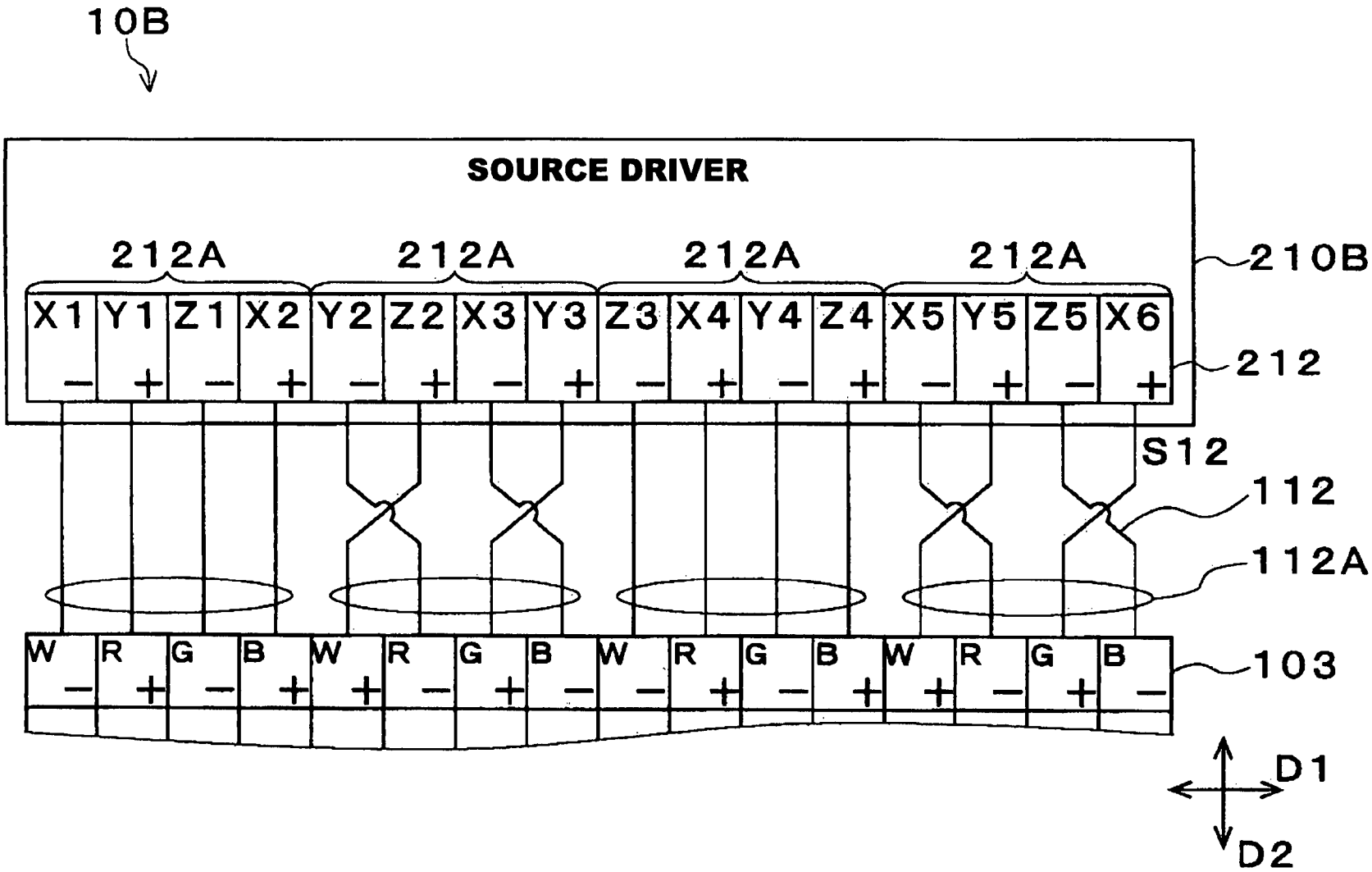
FIG. 14 A schematic diagram for illustrating the display device according to the second embodiment of the invention.

It is to be noted that, as is the case with FIG. 7, in FIG. 14, the gray-scale data X1, Y1, Z1, and the like, to be received by the individual drivers 212 are indicated in the individual drivers 212.

After having received parallel data strings (first parallel data strings) DA1 composed of four data strings W0, R0, G0, and B0, the data rearranging portion 240 first produces parallel data strings (third parallel data strings) DA3 composed of three gray-scale data strings XS, YS, and ZS (see FIG. 15) in the same manner as in the display device 10A (see FIG. 8).

Then, the data rearranging portion 240 applies a delay of one cycle, a delay of two cycles, and a delay of three cycles of the clock signal CK2 in synchronism with the clock signal CK2, thereby producing three parallel data strings (fourth parallel data strings) DA4_L, DA4_2L, and DA4_3L, respectively.

Here, the parallel data strings DA4_L are composed of data strings XS_L, YS_L, and ZS_L obtained by applying a delay of one cycle to the data strings XS, YS, and ZS; the parallel data strings DA4_2L are composed of data strings XS_2L, YS_2L, and ZS_2L obtained by applying a delay of two cycles to the data strings XS, YS, and ZS; and the parallel data strings DA4_3L are composed of data strings XS_3L, YS_3L, and ZS_3L obtained by applying a delay of three cycles to the data strings XS, YS, and ZS. Incidentally, such a delay can be applied by a latch circuit, for example.

The data rearranging portion 240 samples three pieces of data in parallel from the three parallel data strings DA4_L, DA4_2L, and DA4_3L. This sampling is performed in synchronism with a rising edge of the clock signal CK2. In addition, this sampling is performed in the order in which the signal lines 112 are arranged in the non-display area 102, and in accordance with the colors of the subpixels 103 connected to the signal lines 112.

Figure 15:
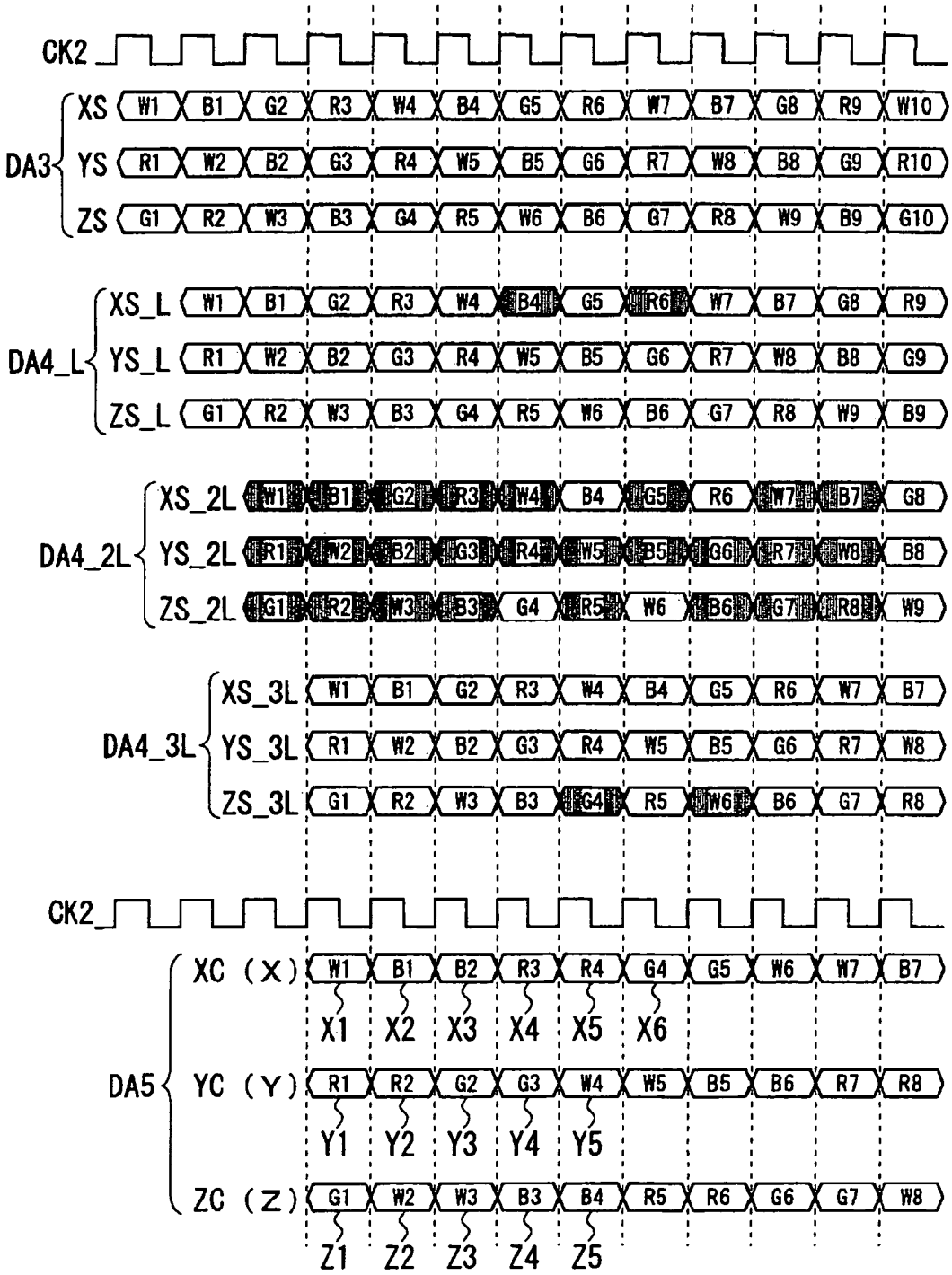
FIG. 15 A timing chart for explaining the display device according to the second embodiment of the invention.

Specifically, as shown in FIG. 15, three pieces of data W1, R1, and G1 (in the figure, they are hatched for the sake of clarity; the same goes for other sampled data) are first sampled from the three parallel data strings DA4_L, DA4_2L, and DA4_3L.

These sampled pieces of gray-scale data W1, R1, and G1 are respectively the gray-scale data of the white (W) subpixel 103 connected to the first signal line 112 (from the left) in the non-display area 102, the gray-scale data of the red (R) subpixel 103 connected to the second signal line 112 in the non-display area 102, and the gray-scale data of the green (G) subpixel 103 connected to the third signal line 112 in the non-display area 102 (see FIG. 14).

That is, three pieces of data W1, R1, and G1 are sampled in the order in which the signal lines 112 are arranged in the non-display area 102, and based on the colors of the subpixels 103 connected to the signal lines 112.

Thereafter, as shown in FIG. 15, another three pieces of data B1, R2, and W2 are sampled at the next rising edge of the clock signal CK2. These sampled pieces of gray-scale data B1, R2, and W2 are respectively the gray-scale data of the blue (B) subpixel 103 connected to the fourth signal line 112 in the non-display area 102, the gray-scale data of the red (R) subpixel 103 connected to the fifth signal line 112 in the non-display area 102, and the gray-scale data of the white (W) subpixel 103 connected to the sixth signal line 112 in the non-display area 102 (see FIG. 14).

That is, sampling of the data W1, R1, and G1 is followed by sampling of next three pieces of data B1, R2, and W2 performed in the order in which the signal lines 112 are arranged in the non-display area 102, and in accordance with the colors of the subpixels 103 connected to the signal lines 112.

Then, another three pieces of data B2, G2, and W3 are sampled at the next rising edge of the clock signal CK2. These sampled pieces of gray-scale data B2, G2, and W3 are respectively the gray-scale data of the blue (B) subpixel 103 connected to the seventh signal line 112 in the non-display area 102, the gray-scale data of the green (G) subpixel 103 connected to the eighth signal line 112 in the non-display area 102, and the gray-scale data of the white (W) subpixel 103 connected to the ninth signal line 112 in the non-display area 102 (see FIG. 14). Sampling is continuously performed in the same manner as described above. Incidentally, this sampling can be performed with a logic circuit or a so-called microprocessor, for example.

The data rearranging portion 240 produces parallel data strings (fifth parallel data strings) DA5 composed of three data strings XC, YC, and ZC from the sequentially sampled data. Specifically, the sequentially sampled data W1, B1, B2, R3, R4, G4, are arranged in series to produce the data string XC; the sequentially sampled data R1, R2, G2, G3, W4, . . . are arranged in series to produce the data string YC; and the sequentially sampled data G1, W2, W3, B3, B4, are arranged in series to produce the data string ZC.

The data rearranging portion 240 then outputs the three data strings XC, YC, and ZC as the gray-scale data X, Y, and Z described above.

Based on the received data strings XC, YC, and ZC, the source driver 210B produces the drive signals S12. That is, the source driver 210B receives the gray-scale data W1, B1, B2, R3, R4, and G4 of the data string XC (that is, the data string X) in this order as gray-scale data X1, X2, X3, X4, X5, and X6, and feeds them to the first, fourth, seventh, tenth, thirteenth, and sixteenth individual drivers 212, respectively (see FIGS. 14 and 15).

Similarly, the source driver 210B receives the gray-scale data R1, R2, G2, G3, and W4 of the data string YC (that is, the data string Y) in this order as the gray-scale data Y1, Y2, Y3, Y4, and Y5, and feeds them to the second, fifth, eighth, eleventh, and fourteenth individual drivers 212.

Similarly, the source driver 210B receives the gray-scale data G1, W2, W3, B3, and B4 of the data string ZC (that is, the data string Z) in this order as the gray-scale data Z1, Z2, Z3, Z4, and Z5, and feeds them to the third, sixth, ninth, twelfth, and fifteenth individual drivers 212, respectively.

In this way, the data rearranging portion 240 of the display device 10B performs the rearrangement of data in a way that corresponds to the liquid crystal panel 100B of a cross wiring type.

With this configuration, when the "+" (or "−") drive signal S12 is applied to the s-th (s is a positive integer between 1 and 4 inclusive) signal line 112 of the odd-numbered signal line group 112A in the display area 101, the "−" (or "+") drive signal S12 is applied to the s-th signal line 112 of the even-numbered signal line group 112A in the display area 101.

Moreover, in each signal line group 112A, the drive signals S12 of opposite polarity are applied to the adjacent signal lines 112 in the display area 101. It is to be noted that, in each pair of signal lines 112 with a reversed arrangement sequence, the "+" (or "−") drive signal S12 and the "−" (or "+") drive signal S12 are each applied to a corresponding one of the pair of signal lines 112.

That is, when the "+" (or "−") drive signal S12 is applied to one of the pair of signal lines 112, the "−" (or "+") drive signal S12 is applied to the other of that pair. As a result, in the display device 10B, it is possible to distribute the polarities of the subpixels 103 in the same manner as in the display device 10A (see FIG. 9). This helps reduce a horizontal shadow (horizontal crosstalk).

In particular, since the data rearranging portion 240 converts the four data strings W0, R0, G0, and B0 to the three data strings X, Y, and Z in the manner as described above, it is possible to use, as the source driver 210B, a general-purpose three-input (RGB input) source driver.

In addition, the above-described output polarity of the source driver 210B is the same as that of a commonly-available general-purpose driver. Therefore, by using the general-purpose driver, the source driver 210B and hence the display device 10B can be produced at lower cost than the source driver 210A whose output polarity requires it to be newly designed and manufactured.

Furthermore, use of the general-purpose driver makes it possible to easily apply the display device 10B to various models.

Incidentally, unlike the descriptions heretofore, it is also possible to configure the display device 10B in such a way that the arrangement sequence of the signal lines 112 of the odd-numbered signal line group 112A is reversed.

Figure 16:
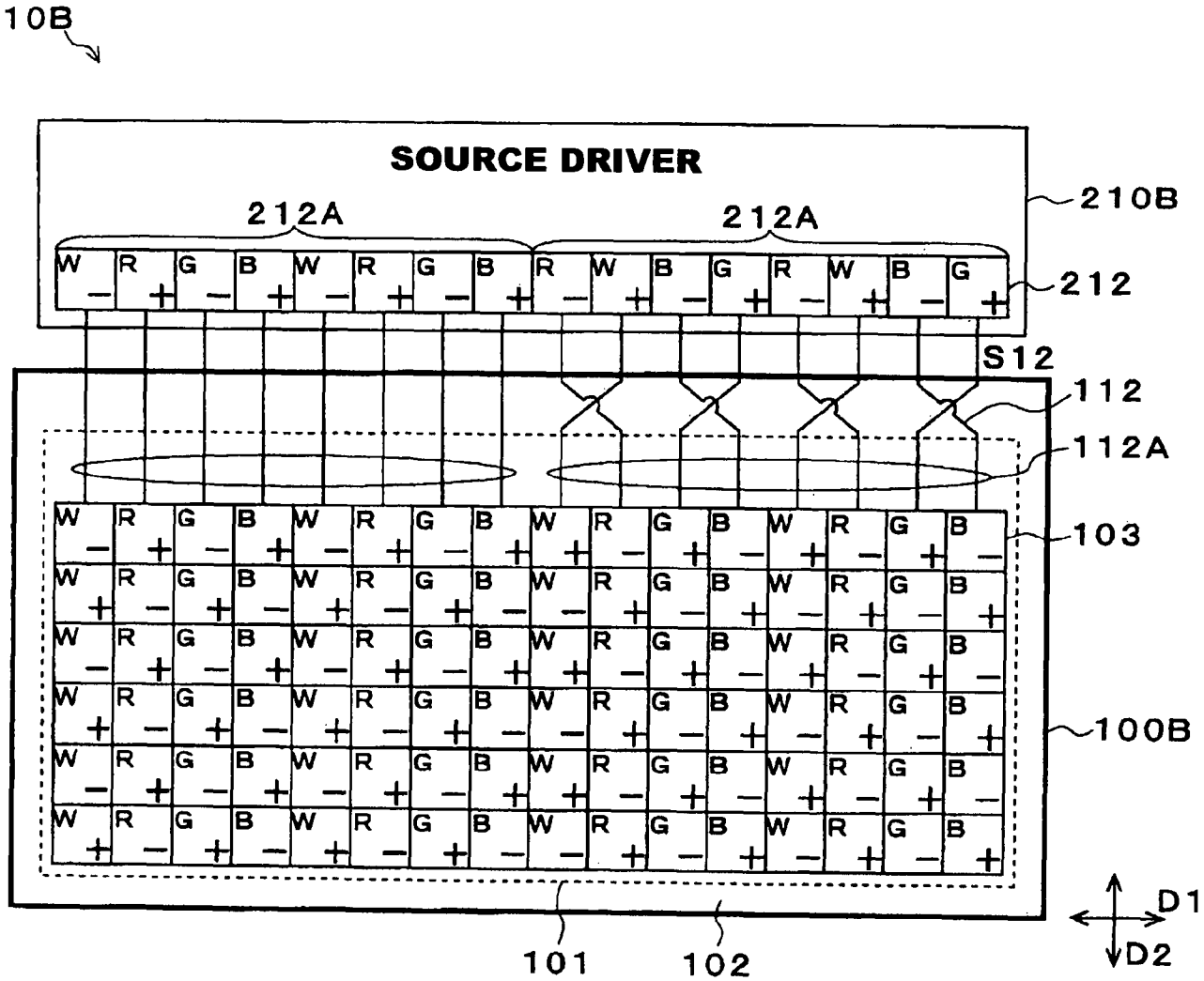
FIG. 16 A schematic diagram for illustrating the display device according to the second embodiment of the invention.

Alternatively, the above-described configuration may be applied to a case in which, as shown in FIG. 16, each signal line group 112A is composed of eight signal lines 112 and each individual driver group 212A is composed of eight individual drivers 212, or to a case in which each signal line group 112A and each individual driver group 212A are composed of signal lines and individual drivers, respectively, whose number is a positive integer multiple of the number of colors (in this example, 4) of the subpixel 103.

Now, while the subpixel 103 maintains the voltage (potential), the effective voltage value of the subpixel 103 changes from the first input value due to the influence of the drive signals S12 applied to the signal lines 112 located on both sides of the subpixel 103.

Figure 17:
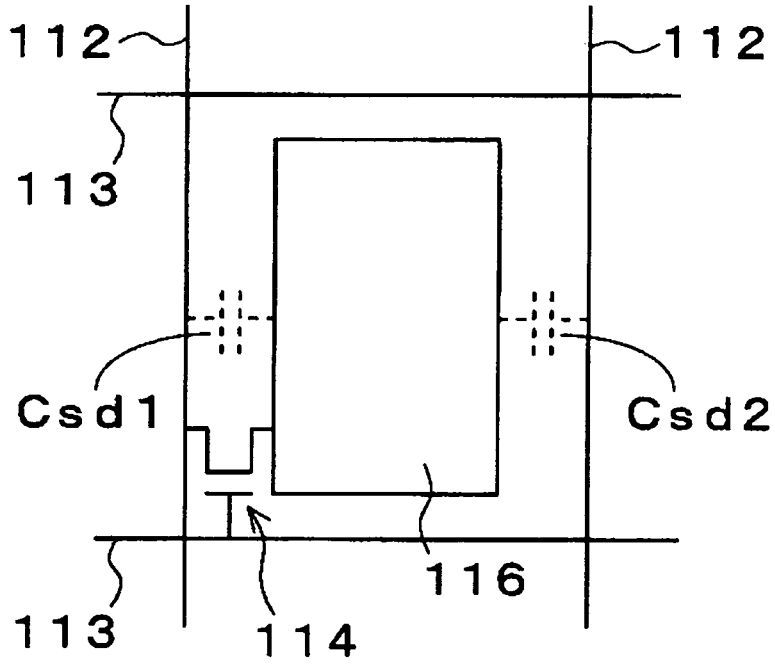
FIG. 17 A schematic diagram for explaining a voltage change in a subpixel.
Figure 17:
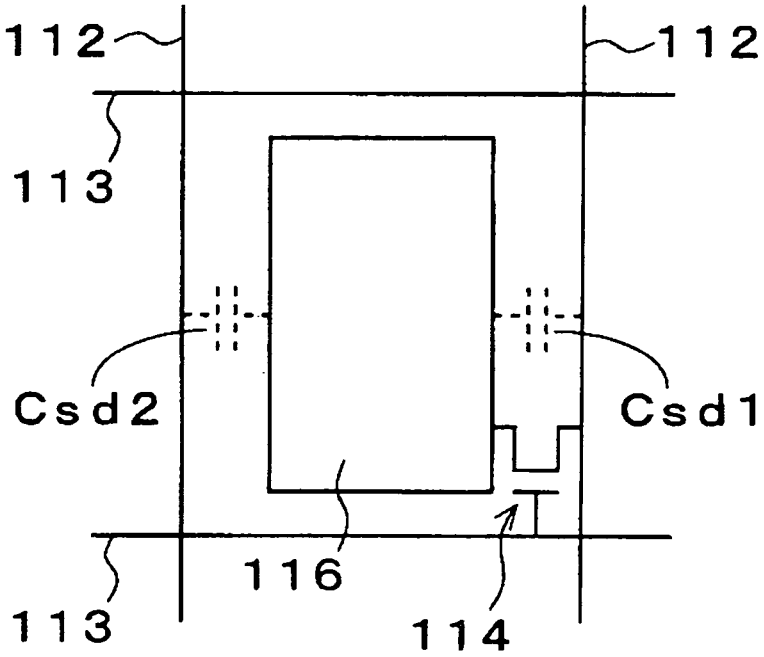

Specifically, as shown in FIG. 17(*a*), a capacitance Csd1 is formed between the subpixel electrode 116 and a signal line 112 to which the electrode 116 is connected, and a capacitance Csd2 is formed between the electrode 116 and a signal line 112 to which the electrode 116 is not connected. The capacitances Csd1 and Csd2 cause a change in the potential of the subpixel electrode 116 (in other words, the potential of the subpixel 103).

In this case, with dot inversion driving, since the drive signals S12 of opposite polarity are applied to the signal lines 112 located on both sides of the subpixel electrode 116, the influences of the signal lines 112 are cancelled out.

On the other hand, in the above-described display devices 10A and 10B shown in FIGS. 9 and 12, respectively, the polarities of the subpixels 103 forming the fourth column are the same as those of the subpixels 103 forming the fifth column, and the drive signals S12 of the same polarity are applied to the fourth and fifth signal lines 112.

The same goes for the eighth and ninth signal lines 112, and for the twelfth and thirteenth signal lines 112. In (the subpixel electrode 116 of) the subpixel 103 located between the signal lines 112 to which the drive signals S12 of the same polarity are applied, the influences of the signal lines 112 located on both sides of the subpixel 103 are not cancelled out.

This reduces the effective voltage value of the subpixel 103 compared to other subpixels 103. As a result, in a case of a liquid crystal panel in normally white mode (a white display is obtained when no voltage is applied; a black display is obtained when voltage is applied), the subpixel 103 with lower voltage is displayed more brightly than when an input signal is applied.

That is, the brightness changes. As a result, since a plurality of subpixels 103 are arranged between the adjacent signal lines 112, there appears a bright line running in the second direction D2. This is unfavorable in terms of quality of display.

Here, the signal lines 112 to which the drive signals S12 of the same polarity are applied are described as "signal lines 112 of the same polarity", and the signal lines 112 to which the drive signals S12 of opposite polarity are applied are described as "signal lines 112 of opposite polarity".

In this case, in the display devices 10A and 10B, the signal lines 112 of the same polarity correspond to two signal lines 112 adjacent to each other, the two signal lines 112 each belonging to a corresponding one of the signal line groups 112A adjacent to each other.

More specifically, assuming that one signal line group 112A is composed of four signal lines 112, the signal lines 112 of the same polarity correspond to the fourth signal line 112 of each signal line group 112A, and the first signal line 112 of the signal line group 112A adjacent to the fourth signal line 112.

On the other hand, in the display devices 10A and 10B, the signal lines 112 of opposite polarity correspond to the adjacent signal lines 112 other than the signal lines 112 of the same polarity.

In addition, the subpixel 103 located between the signal lines 112 of the same polarity is described as a "between-the-same-polarity subpixel 103", and the subpixel 103 located between the signal lines 112 of opposite polarity is described as a "between-the-opposite-polarity subpixel 103".

In this case, in the display devices 10A and 10B shown in FIGS. 9 and 12, respectively, the between-the-same-polarity subpixel 103 corresponds to the subpixel 103 connected to the fourth signal line 112 of each signal line group 112A, that is, the signal line 112 that is highest in number.

On the other hand, unlike FIG. 5, as shown in FIG. 17(*b*), in a case where the subpixel electrode 116 is connected to the signal line 112 on its right side, the between-the-same-polarity subpixel 103 corresponds to the subpixel 103 connected to the first signal line 112 of each signal line group 112A. Incidentally, the between-the-opposite-polarity subpixel 103 corresponds to the subpixels 103 other than the between-the-same-polarity subpixels 103.

In the liquid crystal panels 100A and 100B of the display devices 10A and 10B, a change in brightness associated with the aforementioned voltage change is dealt with as follows. That is, as shown in FIGS. 9 and 12, blue (B) subpixels 103 are disposed as the brightly displayed subpixels 103 in the fourth, eighth, and twelfth columns, i.e., the between-the-same-polarity subpixels 103.

Figure 35:
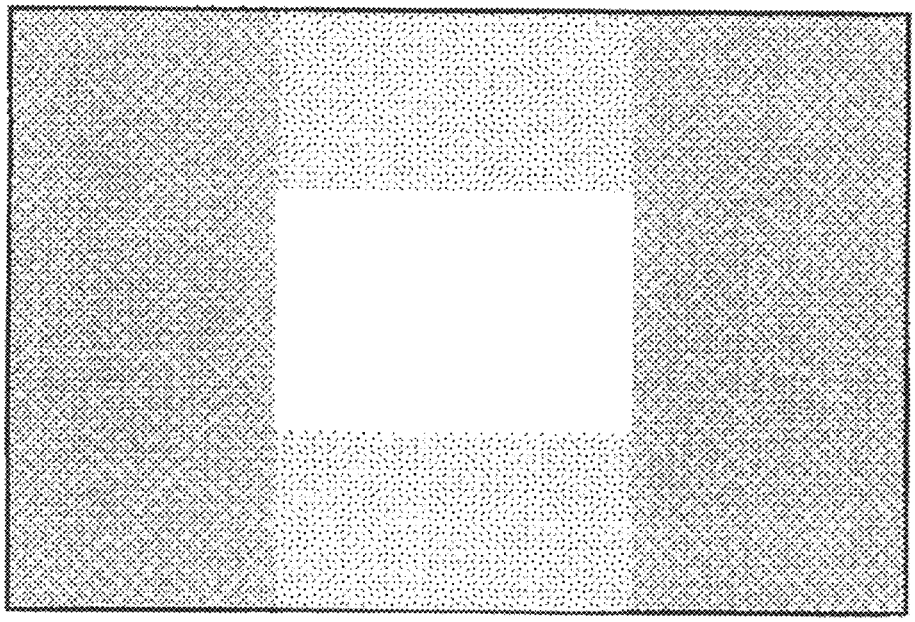
FIG. 35 A schematic diagram for illustrating a vertical shadow.

This is because blue (B) has the lowest brightness among the display colors (four colors) of the liquid crystal panels 100A and 100B, and it is thereby possible to make a change in brightness associated with the aforementioned voltage change less noticeable. At the same time, doing so helps reduce a vertical shadow (see FIG. 35). As a result, it is possible to achieve a satisfactory display.

It is to be noted that comparison of brightness of subpixels 103 of different colors is performed based on the values measured with a brightness photometer, the values being obtained when, for example, display is performed at the same gray level with backlight of the same intensity.

On the other hand, arranging the blue (B) subpixels 103 between the signal lines 112 of the same polarity causes a hue shift, in other words, a white-balance shift at the time of gray scale display (display of black, gray, and white when the same gray level is inputted to all the colors) with a change in brightness.

Figure 18:
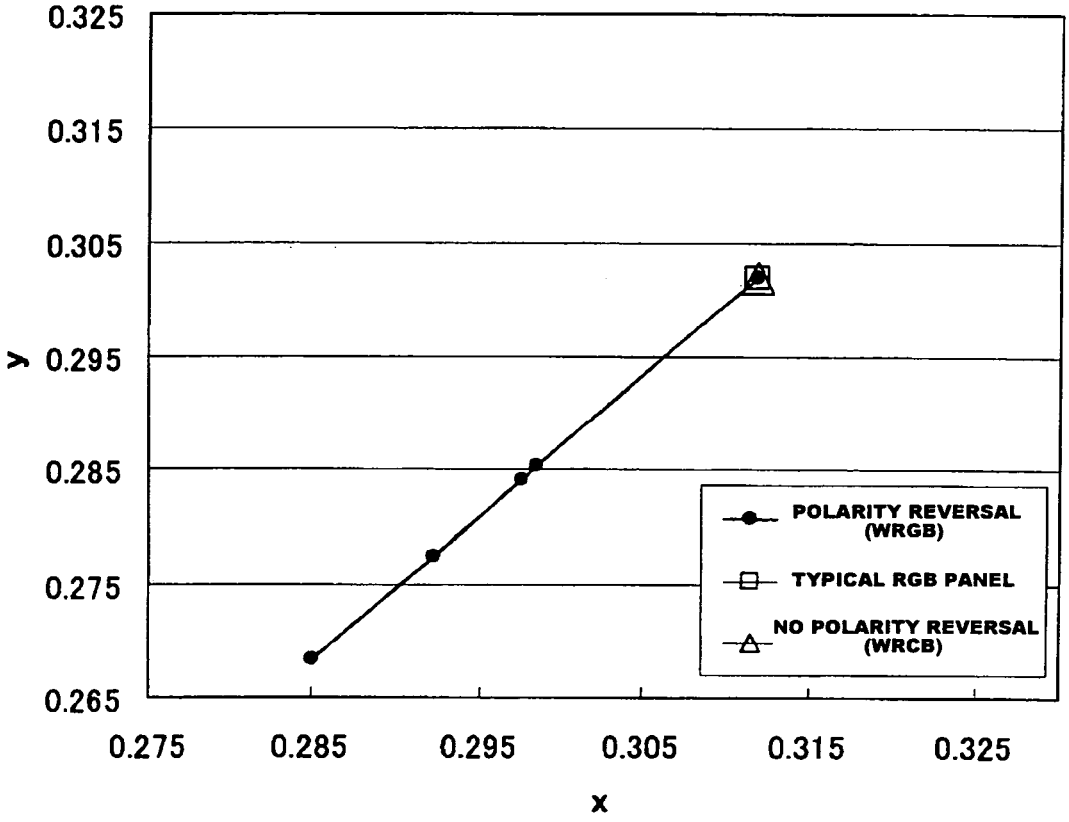
FIG. 18 A graph (a chromaticity diagram) for explaining color of the display device according to the first and second embodiments of the invention.
Figure 31:
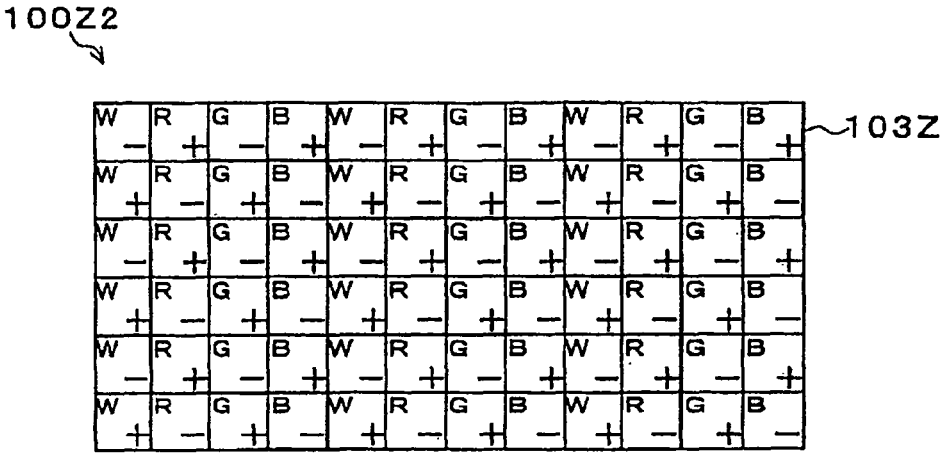
FIG. 31 A schematic diagram for explaining a conventional driving method (Example 2) of the liquid crystal panel.
Figure 32:
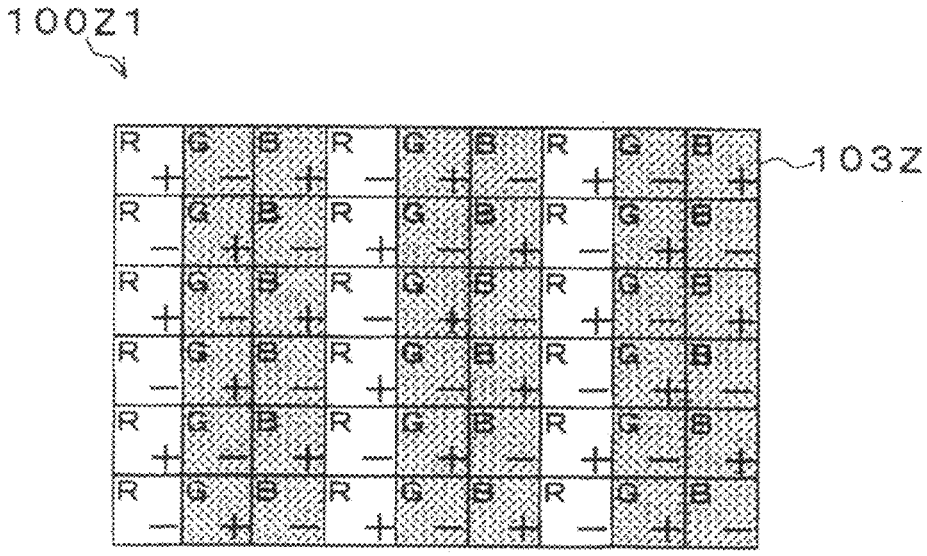
FIG. 32 A schematic diagram for explaining a conventional driving method (Example 1) of the liquid crystal panel.
Figure 33:
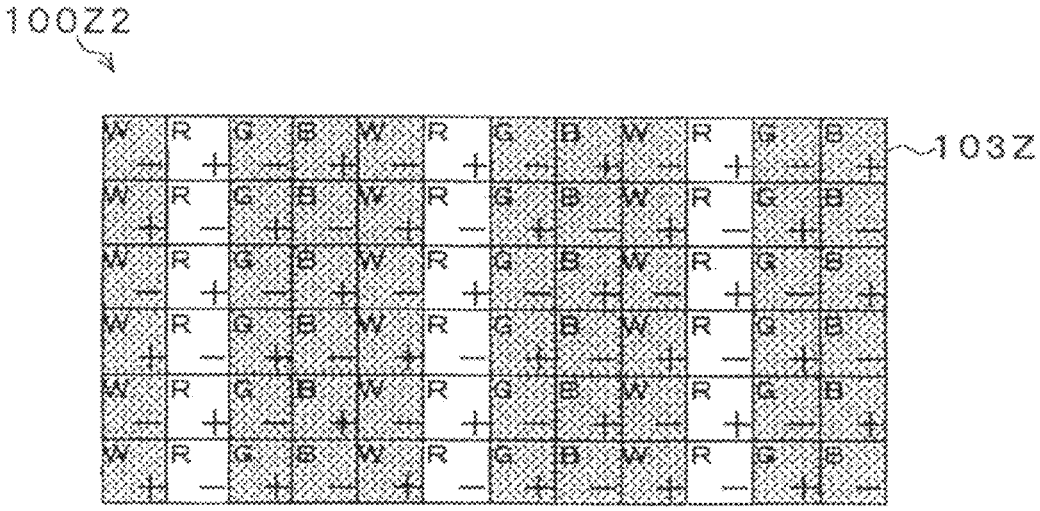
FIG. 33 A schematic diagram for explaining a conventional driving method (Example 2) of the liquid crystal panel.
Figure 34:
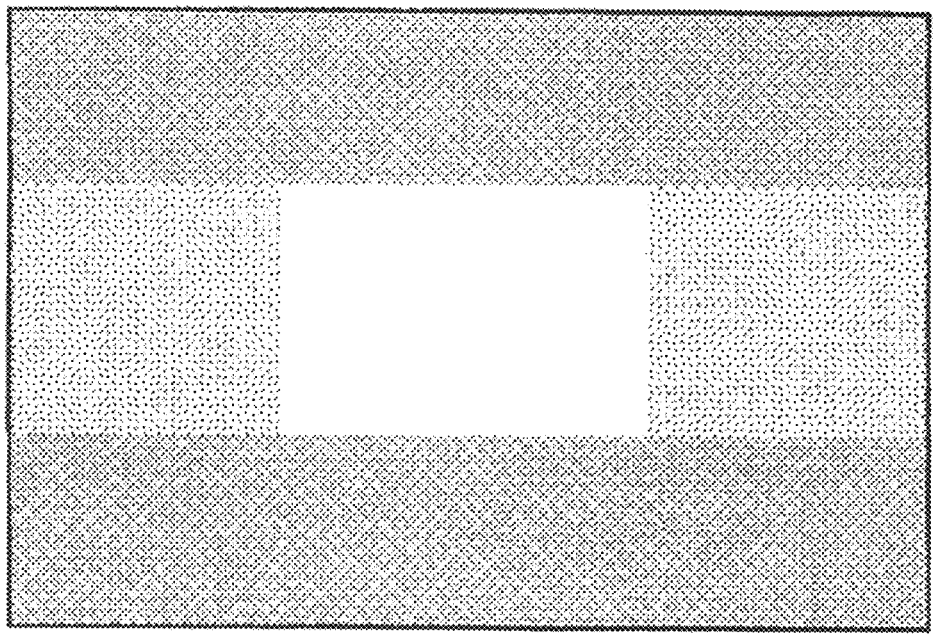
FIG. 34 A schematic diagram for illustrating a horizontal shadow.

Specifically, as shown in a graph (a chromaticity diagram) of FIG. 18, there is a shift toward blue. Incidentally, in FIG. 18, a symbol "●" represents the results of the display devices 10A and 10B (see FIGS. 9 and 12) in which each signal line group 112A is composed of four signal lines 112, a symbol "□" represents the results of the conventional driving method (Example 1) shown in FIG. 30, and a symbol "Δ" represents the results of the conventional driving method (Example 2) shown in FIG. 31.

It is to be noted that FIG. 18 shows the simulation results obtained when the same white backlight is used for the display devices 10A and 10B and the two conventional driving methods. In the display devices 10A and 10B, the spectrum of a light source (a fluorescent tube, an LED, or the like) is adjusted, or different light sources are combined, such that the backlight 300 (see FIG. 1) emits white light shifting toward yellow, in other words, white light mixed with yellow, the complementary color of blue. As a result, with the display devices 10A and 10B, it is possible to improve the hue shift and to obtain a satisfactory white balance.

Here, in normally white mode, if the blue (B) subpixels 103 are arranged between the signal lines 112 of the same polarity as described above, there is a shift toward blue. On the other hand, in normally black mode, if the aforementioned voltage change occurs in the between-the-same-polarity blue (B) subpixels 103, the brightness of these subpixels 103 is reduced. As a result, there is a shift toward yellow at the time of gray scale display.

Therefore, in normally black mode, by making, for example, spectrum adjustments to a light source, such that the backlight 300 emits white light shifting toward blue, in other words, white light mixed with blue, it is possible to obtain a satisfactory white balance.

It is to be understood that the above-described improvement of the hue shift achieved by adjusting the color of the backlight 300 is not limited to a case in which the color of the between-the-same-polarity subpixel 103 is blue (B). This point will be further described below.

Figure 19:
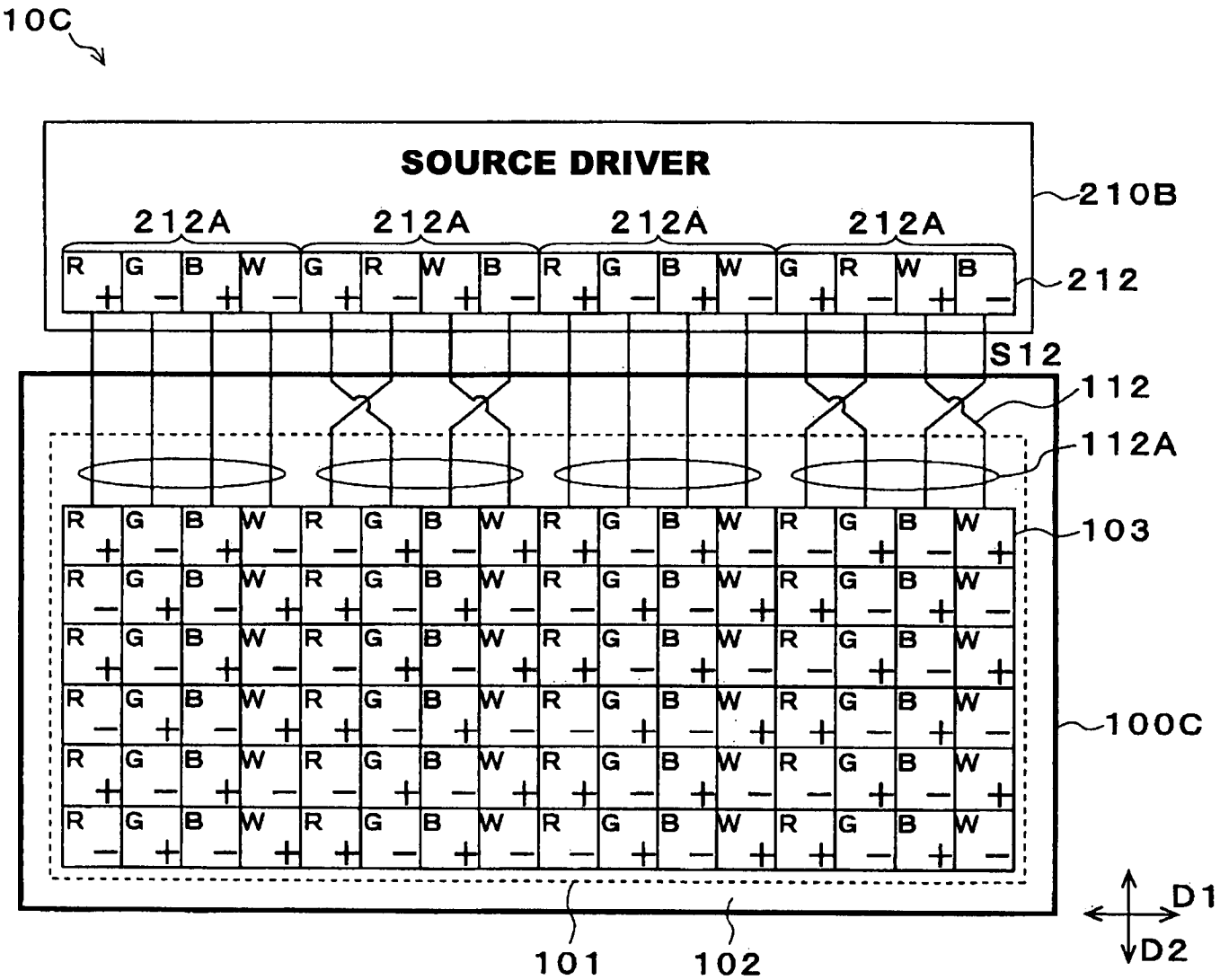
FIG. 19 A schematic diagram for illustrating a display device according to a third embodiment of the invention.

The above-described improvement of the hue shift in gray scale is also possible with a display device 10C according to a third embodiment shown in FIG. 19. A liquid crystal panel 100C of the display device 10C differs from the aforementioned liquid crystal panel 100B (see FIG. 12) in the arrangement of colors. Specifically, in the liquid crystal panel 100C, red (R), green (G), blue (B), and white (W) subpixels 103 are arranged in the first direction D1 in this order in such a way as to form a repeating pattern thereof, and the subpixels 103 of the same color are arranged in the second direction D2.

That is, if the signal line group 112A is defined as described above (FIG. 19 shows an example in which each signal line group 112A is composed of four signal lines), the white (W) subpixel 103 is disposed between the signal lines 112 of the same polarity.

Since white (W) is least colorful among the display colors (four colors) of the liquid crystal panel 100C, it is possible to reduce and even eliminate shift at the time of gray scale display even if the aforementioned voltage change occurs. This helps achieve a satisfactory display. Incidentally, the gray-scale data R0, G0, B0, and W0 can be rearranged according to the color arrangement of the liquid crystal panel 100C by the data rearranging portion 240 (see FIG. 5).

Incidentally, the display device 10C may be configured with a liquid crystal panel 100C of a straight wiring type (see FIG. 9). In the display device 10C, each signal line group 112A and each individual driver group 212A may be composed of, for example, eight signal lines 112 and eight individual drivers 212, respectively (see FIGS. 11 and 16).

With the display device 10C, for example, the following problem may arise. A voltage change in the subpixel 103 is recognized as a change in brightness, which stands out as a vertical stripe in the gray scale display.

For this reason, the determination as to whether the blue (B) subpixel 103 or the white (W) subpixel 103 is disposed between the signal lines 112 of the same polarity may be made depending on the size, resolution, intended use, or the like, of the screen.

Now, the aforementioned change in voltage and brightness that occurs in the between-the-same-polarity subpixel 103 can be reduced by the following driving method. As a fourth embodiment, a description will be given below of a case in which such a driving method is applied to the display devices 10A and 10B (see FIGS. 9 and 12).

Incidentally, in the liquid crystal panels 100A and 100B of the display devices 10A and 10B, the blue (B) subpixel 103, the subpixel 103 having the lowest brightness, is disposed between the signal lines 112 of the same polarity, and this blue (B) subpixel 103 is connected to one of the signal lines 112 of the same polarity located on the both sides thereof. To the other of the signal lines 112 of the same polarity, the white (W) subpixel 103, the subpixel 103 that is least colorful, is connected.

Figure 20:
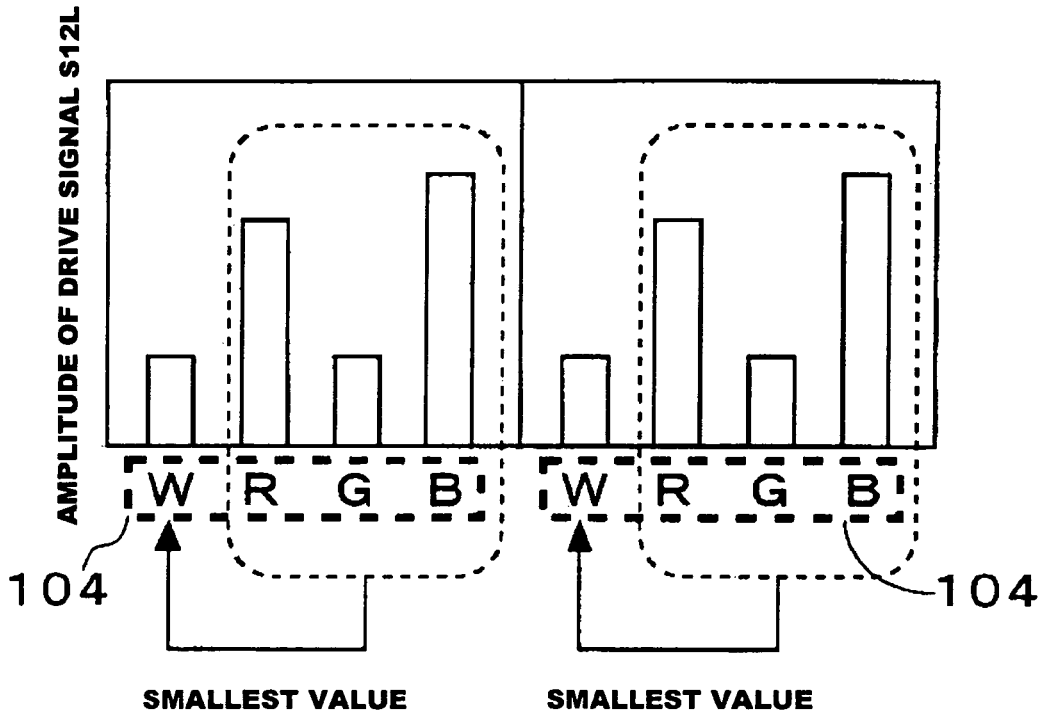
FIG. 20 A schematic diagram for illustrating a display device according to a fourth embodiment of the invention.

First, in a first driving method according to the fourth embodiment, as shown in a schematic diagram of FIG. 20, in each pixel 104, the amplitude of the drive signal S12 for the white (W) subpixel 103 is set so as to be equal to or smaller than the smallest amplitude of those of the drive signals for the red (R), green (G), and blue (B) subpixels 103 (in the figure, green (G)).

Specifically, as described earlier, the control portion 230 (see FIGS. 5 and 6) produces, from the input signal r0, g0, and b0, the red (R), green (G), and blue (B) gray-scale data R0, G0, and B0 and the white (W) gray-scale data W0, and thereby produces data for one pixel, the data being composed of the above four colors. Based on the values of the gray-scale data W0, R0, G0, and B0, the source drivers 210A and 210B determine the amplitude of the drive signal S12.

At this point, for example, in normally black mode, since the lower the gray level (that is, the darker the subpixel 103), the smaller the amplitude of the drive signal S12, the control portion 230 sets the gray level of the white (W) data W0 to be equal to or lower that the lowest gray level of those of the other data R0, G0, and B0. On the other hand, in normally white mode, since the higher the gray level, the smaller the amplitude of the drive signal S12, the control portion 230 sets the gray level of the white (W) data W0 to be equal to or higher than the highest gray level of those of the other data R0, G0, and B0.

With this driving method, it is possible to prevent a high voltage from being applied to the signal line 112 to which the white (W) subpixel 103 is connected, the signal line 112 that is adjacent to the between-the-same-polarity blue (B) subpixel 103 and has an influence on the potential of the blue (B) subpixel 103.

As a result, it is possible to reduce a change in voltage and hence a change in brightness in the blue (B) subpixel 103. This helps achieve a satisfactory display.

Figure 21:
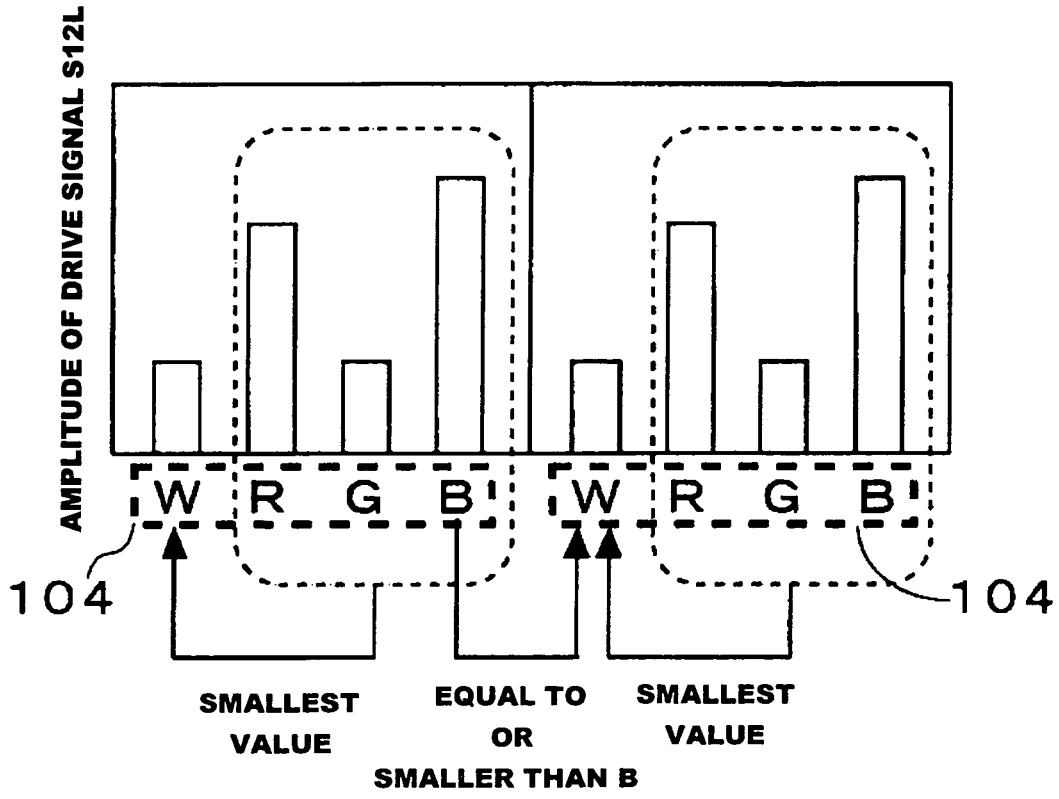
FIG. 21 A schematic diagram for illustrating the display device according to the fourth embodiment of the invention.

Furthermore, in a second driving method according to the fourth embodiment, as shown in a schematic diagram of FIG. 21, the amplitude of the drive signal S12 for the white (W) subpixel 103 is first set by the first driving method described above, and the amplitude is then set to be equal to or smaller than the amplitude of the drive signal S12 for the blue (B) subpixel 103 (belonging to the adjacent pixel 104) adjacent to the white (W) subpixel 103.

This amplitude setting can be performed by the control portion 230 by referring to the gray-scale data B0 of the above-described adjacent blue (B) subpixel 103. With this driving method, the aforementioned effect can also be produced.

Alternatively, in the second driving method, the amplitude of the drive signal S12 for the white (W) subpixel 103 may be set based only on the amplitude of the drive signal S12 for the blue (B) subpixel 103 (belonging to the adjacent pixel 104) adjacent to the white (W) subpixel 103 without using the first driving method (a third driving method).

Here, as compared with the first driving method, the second and third driving methods are considered to be more effective in preventing a high voltage from being applied to the signal line 112 that has an influence on the potential of the blue (B) subpixel 103.

On the other hand, with the first driving method, there is no need to refer to the gray-scale data B0 of the adjacent pixel 104. This makes the method simpler than the second driving method. In other words, it is possible to reduce the data processing workload of the control portion 230.

In addition, since the gray level of white (W) is inherently determined based on the other three colors of the pixel 104, as compared with the second and third driving methods in which the adjacent pixel 104 is referred to, the first driving method can offer a more natural display.

Figure 22:
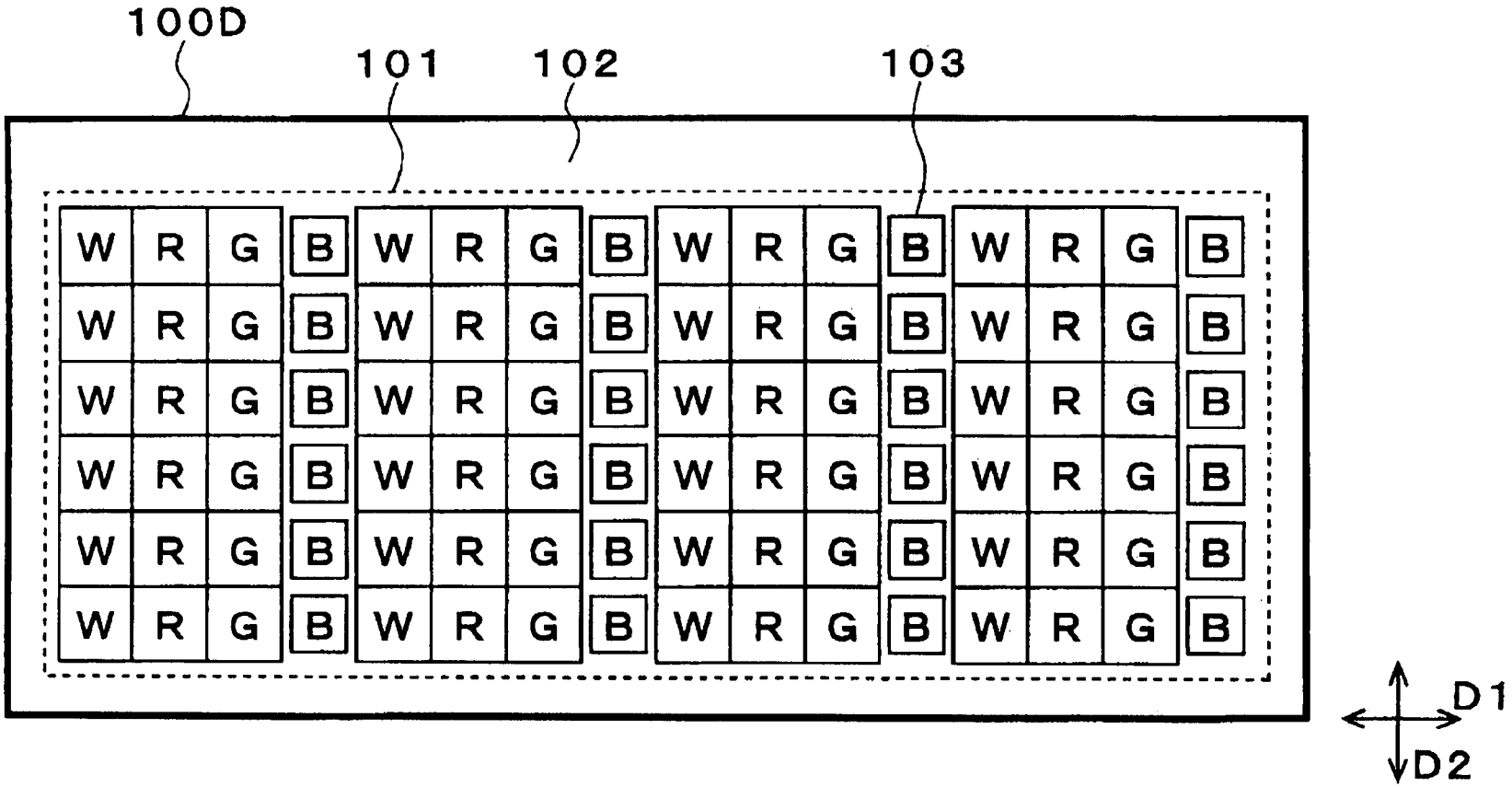
FIG. 22 A schematic diagram for illustrating a liquid crystal panel according to a fifth embodiment of the invention.

Now, it is also possible to make the aforementioned change in brightness that occurs in the between-the-same-polarity subpixel 103 less noticeable with a liquid crystal panel 100D according to a fifth embodiment shown in a schematic diagram of FIG. 22.

That is, in FIG. 22, the larger the subpixel 103, the higher the aperture ratio thereof. In the liquid crystal panel 100D, the aperture ratio of the blue (B) subpixel 103 is set to be lower than those of the subpixels 103 of other three colors. In other respects, the structure the liquid crystal panel 100D is basically the same as those of the liquid crystal panels 100A and 100B described above.

The aperture ratio can be controlled by adjusting a region in which a light-shielding element of the liquid crystal panel 100C, such as the signal line 112, the scanning line 113, the auxiliary capacitance line 117, or the light shielding layer 140, is disposed (see FIGS. 3 and 4). The aperture ratio may be controlled by using two or more elements of those denoted by reference numerals 112, 113, 117, and 140.

It is to be noted that the liquid crystal panel 100D of a straight wiring type or a cross wiring type can be applied to the display devices 10A and 10B described above.

With this liquid crystal panel 100D, the following advantage can be obtained. In a case where the aforementioned change in brightness makes brighter the blue (B) subpixel 103 if the same gray level is inputted in normally white mode, it is possible to make the change in brightness in the blue (B) subpixel 103 less noticeable.

Figure 23:
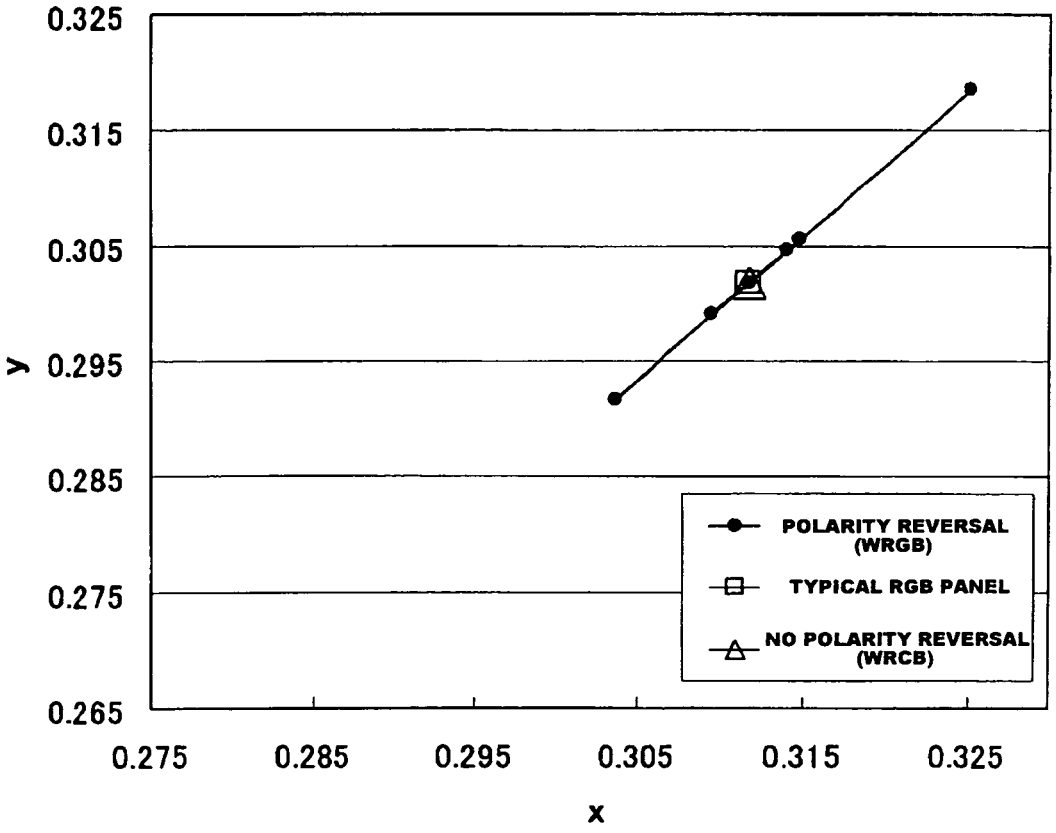
FIG. 23 A graph (a chromaticity diagram) for explaining the display device according to the fifth embodiment of the invention.

Here, a graph (a chromaticity diagram) of FIG. 23 shows the simulation results obtained when the aperture ratio of the blue (B) subpixel 103 is set to be 65% of that of the subpixels 103 of other three colors. In FIG. 23, a symbol "●" represents the result of the display devices 10A and 10B (see FIGS. 9 and 12) in which each signal line group 112A is composed of four signal lines 112, a symbol "□" represents the results of the conventional driving method (Example 1) shown in FIG. 30, and a symbol "Δ" represents the results of the conventional driving method (Example 2) shown in FIG. 31.

A comparison of FIG. 23 and the aforementioned FIG. 18 reveals that the liquid crystal panel 100D contributes to the improvement of white balance. This improvement is due to a reduction in brightness of the blue (B) subpixel 103 as a result of a reduction in the aperture ratio thereof.

Preferably, the aperture ratio is adjusted when gray display (halftone display) is performed in which variations in brightness are highly visible. Incidentally, variations in brightness are most visible when display (gray display) is performed at a given gray level at which the transmittance of the subpixel 103 is of the order of 10 to 40%. Therefore, it is preferable that the aperture ratio be adjusted at that given gray level, in such a way that the subpixels 103 of different colors have the same brightness.

As a result, it is possible to make a change in brightness less noticeable at any gray level. Also, as will be understood from FIG. 23, the average white balance at different gray levels becomes equal to that of the typical RGB panel, indicating that a satisfactory white balance is obtained.

Figure 24:
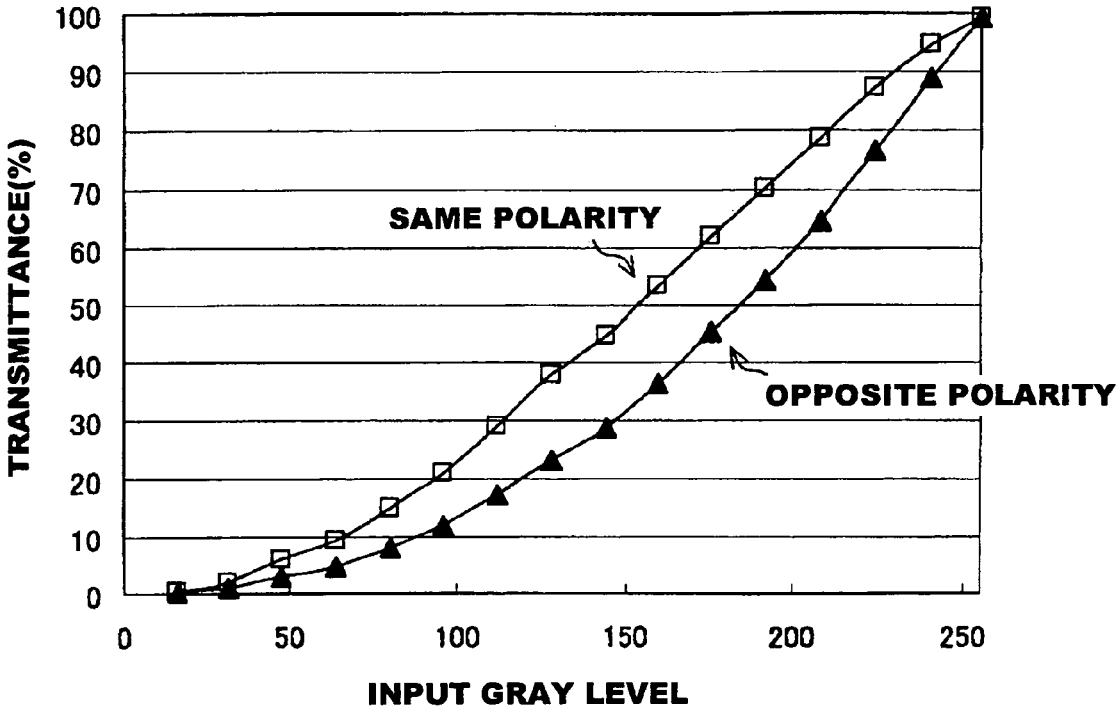
FIG. 24 A graph for explaining the display device according to the fifth embodiment of the invention.

Here, the relationship between the input gray level to the subpixel 103 and the transmittance thereof is shown in FIG. 24. In FIG. 24, a symbol "□" represents the between-the-same-polarity subpixel 103, and a symbol "▲" represents the between-the-opposite-polarity subpixel 103. According to FIG. 24, as described earlier, the transmittance, i.e., brightness of the between-the-same-polarity subpixel 103 is higher than that of the between-the-opposite-polarity subpixel 103.

Figure 25:
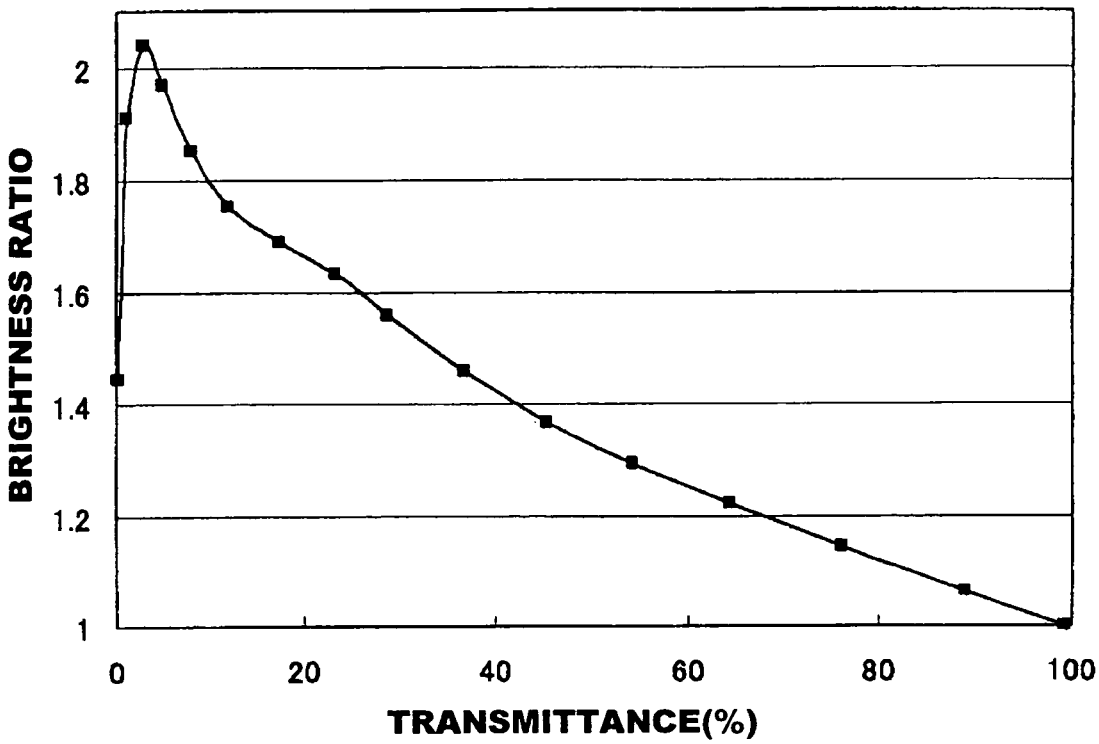
FIG. 25 A graph for explaining the display device according to the fifth embodiment of the invention.

In this case, since there is a nonlinear relationship between the voltage applied to the liquid crystal and the transmittance (brightness), the difference in transmittance or the transmittance ratio between the two varies depending on the gray level. This point is illustrated in FIG. 25. In FIG. 25, the horizontal axis represents the transmittance of the between-the-opposite-polarity subpixel 103, and the vertical axis represents the brightness ratio (in other word, the transmittance ratio) between the two.

According to FIG. 25, in a case where the aperture ratio is adjusted at a given gray level at which the transmittance is of the order of 10 to 40%, it is necessary simply to reduce the aperture ratio of the between-the-same-polarity subpixel 103 by approximately 50 to 70%.

Figure 26:
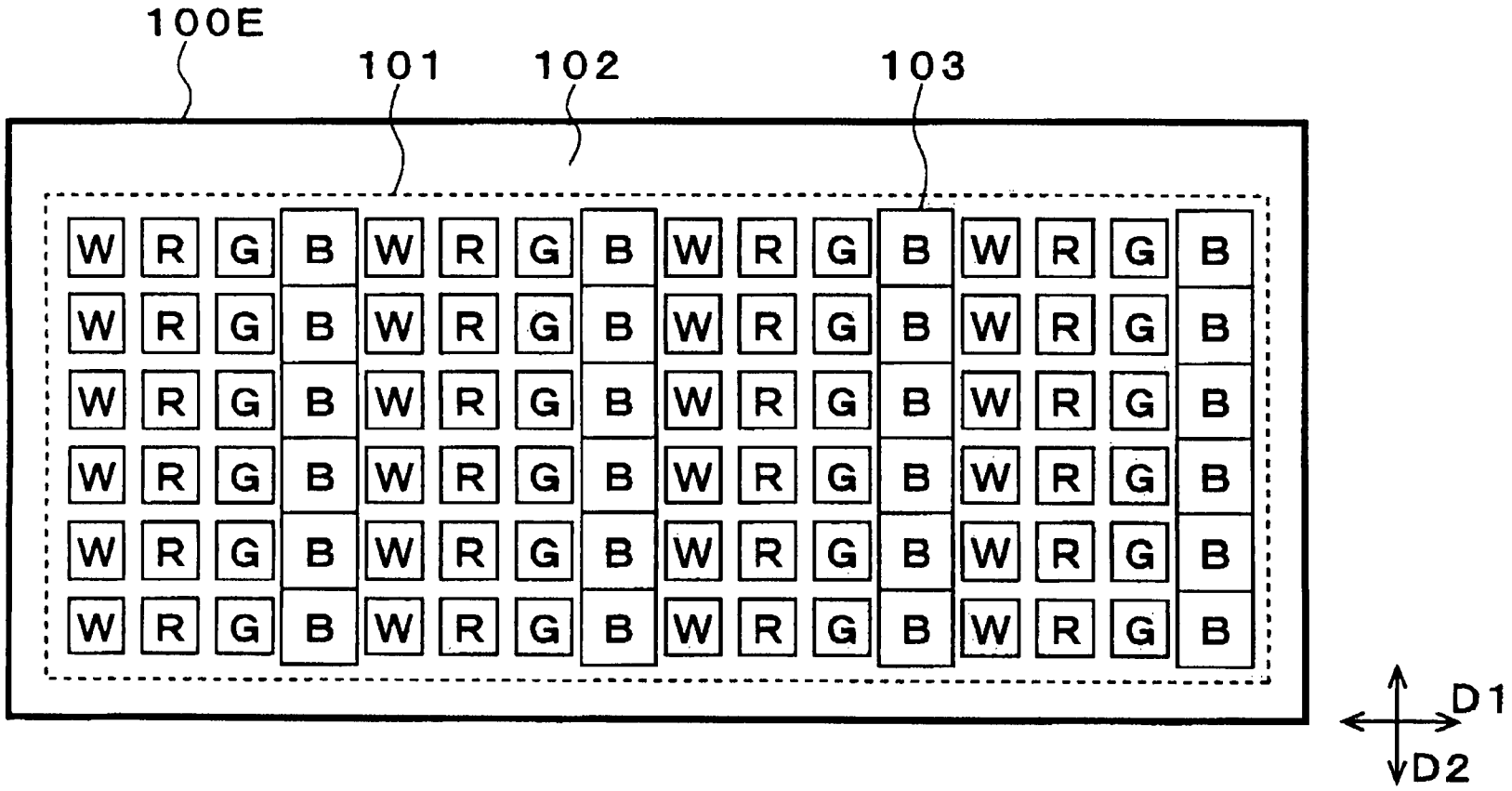
FIG. 26 A schematic diagram for illustrating another liquid crystal panel according to the fifth embodiment of the invention.

Incidentally, in normally black mode, like a liquid crystal panel 100E show in FIG. 26, it is necessary simply to increase the aperture ratio of the blue (B) subpixel 103 so as to be higher than that of the subpixels 103 of other three colors.

It is to be understood that a subpixel whose aperture ratio is to be adjusted is not limited to the blue (B) subpixel 103. The above-described effects can be obtained by adjusting the aperture ratio of any between-the-same-polarity subpixel 103.

Figure 27:
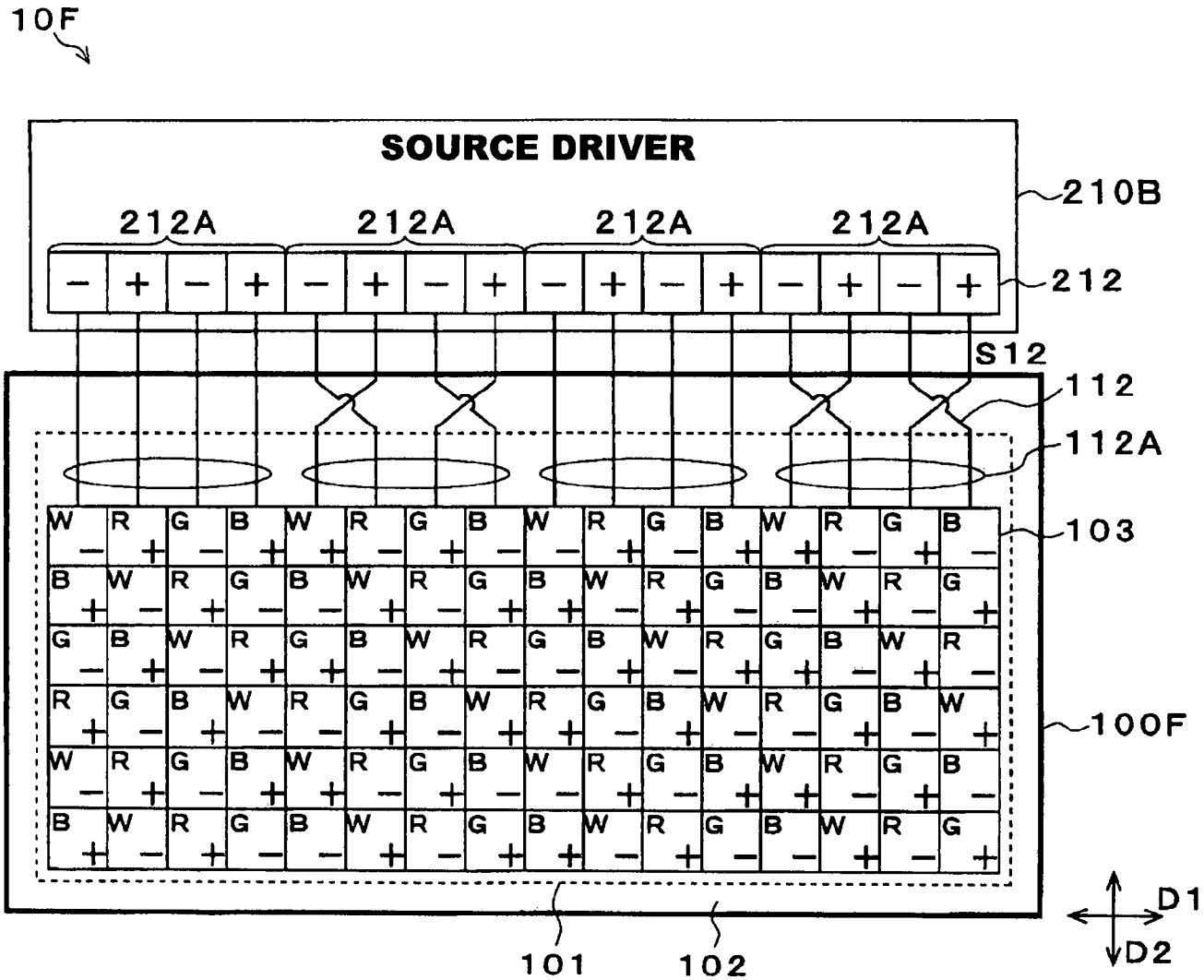
FIG. 27 A schematic diagram for illustrating a display device according to a sixth embodiment of the invention.

Now, it is also possible to make the aforementioned change in brightness that occurs in the between-the-same-polarity subpixel 103 less noticeable with a display device 10F according to a sixth embodiment shown in a schematic diagram of FIG. 27.

The display device 10F differs from the aforementioned display device 10B of FIG. 12 in that the liquid crystal panel 100B is replaced with a liquid crystal panel 100F. Specifically, the liquid crystal panel 100F differs from the liquid crystal panel 100B shown in FIG. 12 in that the subpixels 103 in the second row are each shifted rightward by one subpixel, the subpixels 103 in the third row are each shifted rightward by two subpixels, and the subpixels 103 in the fourth to sixth rows are each shifted in a similar manner.

As a result, the subpixels 103 of the above four colors are connected to each signal line 112 in a given order in such a way as to form a repeating pattern. Therefore, the subpixel 103 of different colors are disposed as the between-the-opposite-polarity subpixel 103.

With the display device 10F, it is therefore possible to prevent a change in brightness in the between-the-opposite-polarity subpixel 103 from occurring in a particular color. This makes a change in brightness less noticeable.

In other respects, the liquid crystal panel 100F is basically the same as the liquid crystal panel 100B shown in FIG. 12 in structure, and can be so modified as to be a panel of a straight wiring type (see FIG. 9). Incidentally, the gray-scale data R0, G0, B0, and W0 can be rearranged according to the color arrangement of the liquid crystal panel 100F by the data rearranging portion 240 (see FIG. 5).

Figure 28:
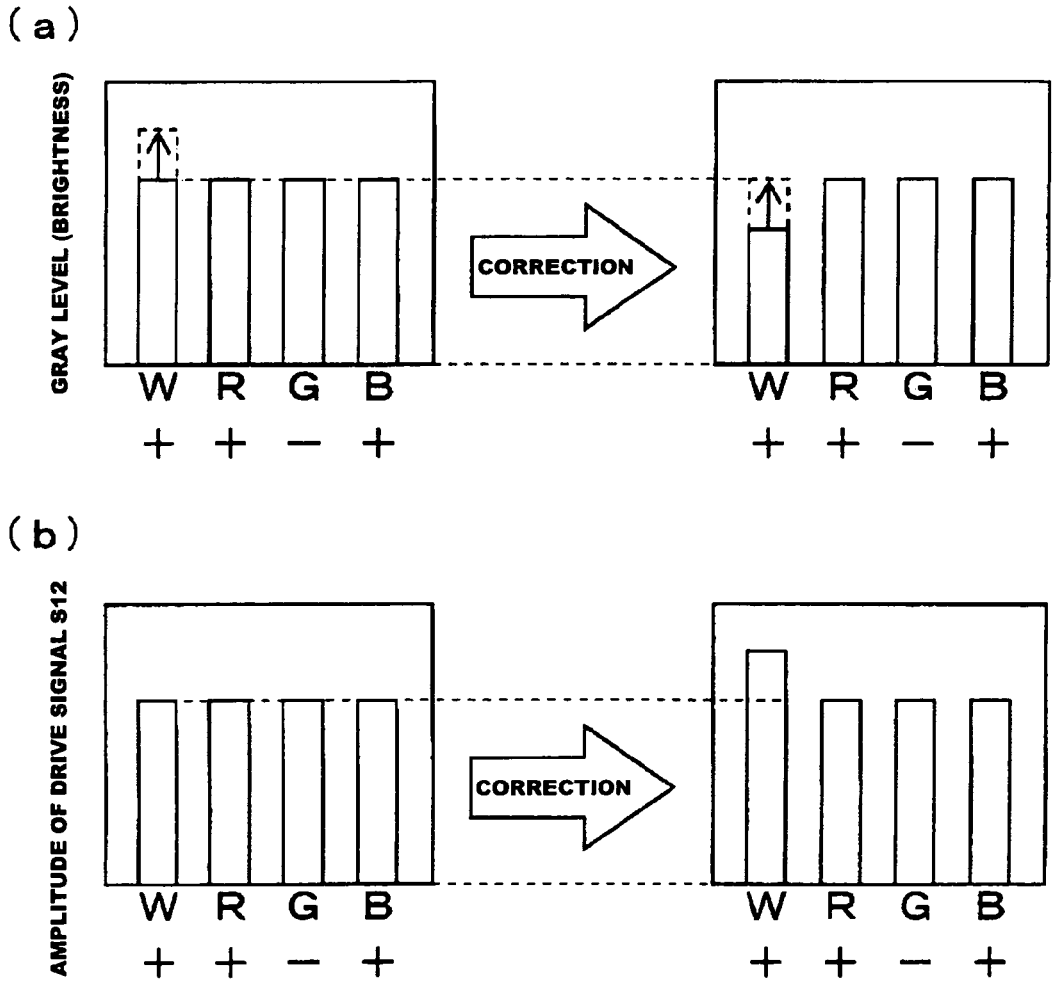
FIG. 28 A schematic diagram for explaining a driving method according to a seventh embodiment of the invention.

Now, it is also possible to make the aforementioned change in brightness that occurs in the between-the-same-polarity subpixel 103 less noticeable by applying a driving method according to a seventh embodiment shown in a schematic diagram of FIG. 28 to the display device 10A and the like. It is to be understood that, as an example of implementation, FIG. 28 deals with a case in which the between-the-same-polarity subpixel 103 is white (W); however, the color is not limited in any way to this particular color.

In normally white mode, if the aforementioned change in voltage (reduction in voltage) occurs in the between-the-same-polarity white (W) subpixel 103, the brightness thereof is increased (see a portion indicated by dashed lines in FIG. 28 (*a*)). By the driving method according to the seventh embodiment, with consideration given to this increase in brightness, a correction is made to the drive signal S12 to be applied to the white (W) subpixel 103 (see FIG. 28 (*b*)).

Specifically, with consideration given to the influence of the drive signal S12 applied to one signal line 112 of the signal lines 112 of the same polarity, the one signal line 112 to which the between-the-same-polarity subpixel 103 is not connected (in the example shown in FIG. 28, the one signal line 112 to which the red (R) subpixel 103 is connected), the drive device 200 (see FIG. 5) corrects the amplitude of the drive signal S12 to be fed to the between-the-same-polarity white (W) subpixel 103 in advance.

More specifically, in normally white mode, as shown in FIG. 28 (*b*), the amplitude of the drive signal S12 to be fed to the between-the-same-polarity white (W) subpixel 103 is increased.

Such a correction that is made to increase the amplitude is made possible by reducing the value (gray level) of the gray-scale data W0 of white (W) based on the value (gray level) of the gray-scale data R0 of red (R) adjacent thereto when, for example, the control portion 230 (see FIG. 5) produces the gray-scale data R0, G0, B0, and W0 from the input signals r0, g0, and b0.

Figure 29:
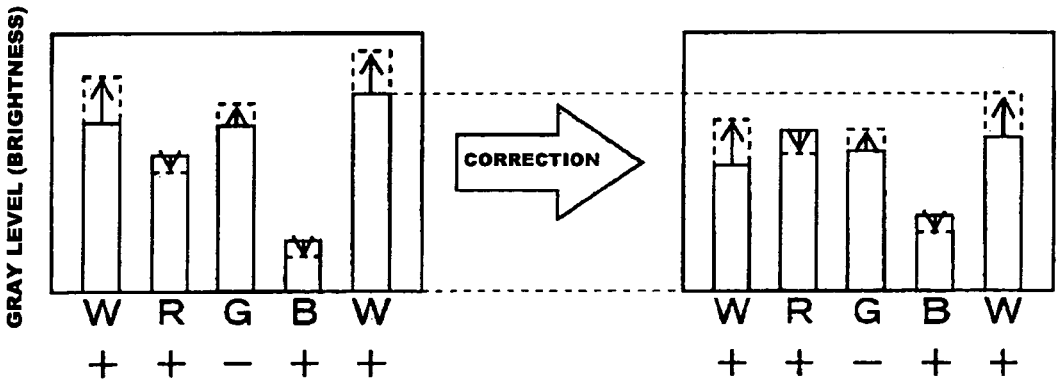
FIG. 29 A schematic diagram for explaining another driving method according to the seventh embodiment of the invention.

Incidentally, since the potentials of not only the between-the-same-polarity subpixels 103 but also of any subpixels 103 are influenced by the voltage (potential) of the signal lines 112 located on both sides thereof, by simply feeding the gray levels (brightness) of the input signals r0, g0, and b0 to the subpixels 103 as they are, display is not performed at exactly desired gray levels (see FIG. 29).

Also in this case, it is necessary simply to correct the amplitude of the drive signals S12 to be fed to the subpixels 103 in advance in the manner described above by using, for example, a technique disclosed in Patent Document 6.

In doing so, by combining such a correction with the aforementioned correction of the drive signal S12 to be fed to the between-the-same-polarity subpixel 103 helps provide a more satisfactory display. In this case, as described above, since the between-the-same-polarity subpixel 103 differs from the other subpixels 103 (that is, the between-the-opposite-polarity subpixels 103) in the polarity state of the signal lines 112 located on both sides thereof and hence in the amount of correction (correction formula). Specifically, a larger amount of correction is performed for the between-the-same-polarity subpixel 103.

Incidentally, also in normally black mode, a correction can be performed in the same manner.

The descriptions heretofore deal with cases in which the grouping of the signal lines 112 is done in an ascending order, the signal line 112 on the extreme left being the first, such that they are divided into signal line groups 112A. Alternatively, the grouping may be done in an ascending order, any signal line 112 following the one on the extreme left being the first, such that the signal lines 112 are divided into signal line groups 112A.

The above explanation holds for that case by newly treating any signal line 112 following the one on the extreme left as the first. The same goes for the grouping of the individual driver groups 212A.

In addition, the descriptions heretofore deal with cases in which the liquid crystal panel 100A or the like is composed of four colors: white (W), red (R), green (G), and blue (B). However, the colors and the number of colors of subpixels 103 are not limited to those specifically described above; any color and any number of subpixel 103 may be used.

For example, the liquid crystal panel 100A or the like may be composed of four colors: red (R), green (G), blue (B), and yellow (Y) (Modified Example 1), may be composed of four colors: cyan (C), magenta (M), yellow (Y), and green (G) (Modified Example 2), or may be composed of six colors: red (R), green (G), blue (B), cyan (C), magenta (M), and yellow (Y) (Modified Example 3).

Here, among the colors of Modified Examples 1 to 3, blue (B) is the lowest in brightness (transmittance), followed by red (R), magenta (M), green (G), and cyan (C), and yellow (Y) is the highest in brightness. Therefore, in Modified Examples 1 and 3, the "color with the lowest brightness" in the above explanation is blue (B), for example; in Modified Example 2, magenta (M), for example. In addition, among those colors, the "least colorful color" in the above explanation is, for example, yellow (Y).

The descriptions heretofore deal with cases in which the blue (B) subpixel 103 is disposed between the signal lines 112 of the same polarity for explaining the occurrence of a hue shift and the improvement thereof; however, the color of the between-the-same-polarity subpixel 103 is not limited to blue (B).

For example, the color thereof may be magenta (M) or the like, which is another example of the color with the lowest brightness, or yellow (Y) or the like, which is another example of the least colorful color.

That is, in normally white mode, by using the backlight device 300 (see FIG. 1) that emits light having a mixed color of the complementary color of the color of the between-the-same-polarity subpixel 103 and white; in normally black mode, by using the backlight device 300 that emits light having a mixed color of the color of the between-the-same-polarity subpixel 103 and white, it is possible to improve, the hue shift caused by the color of the between-the-same-polarity subpixel 103.

Furthermore, the descriptions heretofore deal with cases in which the display device 10A or the like is a transmissive liquid crystal display device provided with the backlight device 300 (see FIG. 1); however, the above-described various structures (except for the structure in which the spectrum of light emitted from the backlight 300 is adjusted) and driving methods can be applied to a so-called reflective/semi-reflective liquid crystal display device provided with no backlight device 300, and can also be applied to a so-called semi-transmissive liquid crystal display device.

Furthermore, the display member is not limited to the liquid crystal panel 100A; it may be an EL (electroluminescence) panel, for example.

INDUSTRIAL APPLICABILITY

According to the present invention, it is possible to provide display devices and driving methods for driving a display member, the display devices and methods that can reduce a shadow (crosstalk).

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A display device, comprising:

a display member including, a plurality of subpixels of P (P is an even number equal to or larger than 4) different colors, the plurality of subpixels being two-dimensionally arranged in a display area, a plurality of signal lines connected to the plurality of subpixels, and a plurality of scanning lines crossing the signal lines at different levels; and a drive device including, a driver connected to the plurality of signal lines, the driver configured to output a first signal and a second signal as a drive signal to be applied to each signal line, the first and second signals being opposite to each other in polarity, wherein the plurality of signal lines are arranged in the display area in a first direction, and each extend in a second direction in the display area, the first direction and the second direction intersecting at right angles, wherein the plurality of scanning lines are arranged in the display area in the second direction and each extend in the first direction, wherein, if the plurality of signal lines are divided into a plurality of signal line groups, each being composed of Q (Q is a positive integer multiple of P) consecutive signal lines in the display area, the plurality of subpixels are two-dimensionally arranged in such a way that a sequence of subpixels of P different colors is repeated in the first direction, whereby, in a same row arranged in the first direction, the subpixels connected to each s-th (s is a positive integer between 1 and Q inclusive) signal line of each signal line group correspond to a single one of the P colors and are connected to a same one of the scanning lines, wherein the display device is configured to sequentially drive the plurality of scanning lines, and is so structured that, if the first signal is applied to the s-th signal line of an odd-numbered signal line group in the display area, the second signal is applied, with a same timing, to the s-th signal line of an even-numbered signal line group in the display area, and that the first signal and the second signal are each applied, with a same timing, to a corresponding one of the signal lines of each signal line group, the signal lines being adjacent to each other in the display area, wherein the driver has a plurality of individual drivers provided one for each of the plurality of signal lines, and is so configured that, if an odd-numbered individual driver outputs the first signal, an even-numbered individual driver outputs the second signal, wherein the signal lines of one of an odd-numbered signal line group and an even-numbered signal line group further extend into a non-display area of the display member, the non-display area being an area other than the display area, while maintaining an arrangement sequence in the display area, wherein the signal lines of the other of the odd-numbered signal line group and the even-numbered signal line group further extend into the non-display area, and an arrangement sequence of a u-th (u is an odd number between 1 and Q inclusive) signal line and a (u+1)-th signal line thereof is reversed in the non-display area, wherein, a v-th (v is a positive integer) individual driver is connected, in the non-display area, to a v-th signal line in the non-display area.

2. The display device of claim 1, wherein Q is equal to P.

3. The display device of claim 1, wherein the drive device produces a plurality of sets of second parallel data strings by applying a delay to first parallel data strings in synchronism with a first clock, the first parallel data strings being composed of color-by-color data strings on gray levels of the subpixels, third parallel data strings by sampling K (K is a positive integer smaller than P) pieces of data in parallel from the plurality of sets of second parallel data strings, in synchronism with a second clock having a frequency that is higher than a frequency of the first clock and in an order in which colors are arranged in the first direction in the display area, the third parallel data strings being composed of K data strings, a plurality of sets of fourth parallel data strings by applying a delay to the third parallel data strings in synchronism with the second clock, and fifth parallel data strings by sampling K pieces of data in parallel from the plurality of sets of fourth parallel data strings in synchronism with the second clock, wherein the driver produces the drive signal based on the fifth parallel data strings.

4. The display device of claim 3, wherein K is equal to 3.

5. The display device of claim 1, wherein, between two signal lines adjacent to each other, the two signal lines each belonging to a corresponding one of the signal line groups adjacent to each other, the subpixel having a least colorful color of the P different colors is disposed.

6. The display device of claim 5, wherein the least colorful color is any one of white (W) and yellow (Y).

7. The display device of claim 1, wherein, between two signal lines adjacent to each other, the two signal lines each belonging to a corresponding one of the signal line groups adjacent to each other, the subpixel having a color with a lowest brightness of the P different colors is disposed.

8. The display device of claim 7, wherein the color with the lowest brightness is any one of blue (B) and magenta (M).

9. The display device of claim 7, wherein the subpixel having the color with the lowest brightness is connected to one of the two signal lines, and the subpixel having a least colorful color of the P different colors is connected to the other of the two signal lines, wherein the drive device sets, for each pixel composed of the subpixels of P different colors, an amplitude of the drive signal for the subpixel having the least colorful color so as to be equal to or smaller than a smallest amplitude of amplitudes of the drive signals for the subpixels of other colors.

10. The display device of claim 7, wherein the subpixel having the color with the lowest brightness is connected to one of the two signal lines, and the subpixel having a least colorful color of the P different colors is connected to the other of the two signal lines, wherein the drive device sets an amplitude of the drive signal to be applied to the other signal line so as to be equal to or smaller than an amplitude of the drive signal to be applied to the one signal line.

11. The display device of claim 10, further comprising:

a backlight device structured so as to emit either light having a mixed color of the color of the subpixel disposed between the two signal lines and white or light having a mixed color of a complementary color of the color of the subpixel disposed between the two signal lines and white, the backlight device being disposed in such a way that the light of the mixed color is shone onto the display member.

12. The display device of claim 1, wherein the subpixel disposed between two signal lines adjacent to each other, the two signal lines each belonging to a corresponding one of the signal line groups adjacent to each other, has an aperture ratio lower than an aperture ratio of other subpixels.

13. The display device of claim 1, wherein the subpixel disposed between two signal lines adjacent to each other, the two signal lines each belonging to a corresponding one of the signal line groups adjacent to each other, has an aperture ratio higher than an aperture ratio of other subpixels.

14. The display device of claim 12, wherein the aperture ratio is set so that a brightness of the subpixel disposed between the two signal lines becomes equal to a brightness of the other subpixels at a time of gray display.

15. The display device of claim 1, wherein, between two signal lines adjacent to each other, the two signal lines each belonging to a corresponding one of the signal line groups adjacent to each other, the subpixels of a plurality of colors are disposed in the second direction.

16. The display device of claim 15, wherein, between the two signal lines, the subpixels of P different colors are repeatedly arranged in the second direction.

17. The display device of claim 1, wherein the drive device corrects an amplitude of the drive signal to be fed to the subpixel disposed between two signal lines adjacent to each other, the two signal lines each belonging to a corresponding one of the signal line groups adjacent to each other, based on an amplitude of the drive signal to be applied to one signal line of the two signal lines, the one signal line that is not connected to the subpixel disposed between the two signal lines.

18. The display device of claim 1, wherein the drive device corrects an amplitude of the drive signal to be fed to each subpixel based on an amplitude of the drive signal to be applied to the signal lines adjacent to each other.

19. The display device of claim 1, wherein P different colors are any one of four different colors of red (R), green (G), blue (B), and white (W), four different colors of red (R), green (G), blue (B), and yellow (Y), four different colors of cyan (C), magenta (M), yellow (Y), and green (G), or six different colors of red (R), green (G), blue (B), cyan (C), magenta (M), and yellow (Y).

20. The display device of claim 1, wherein the display member is a liquid crystal panel.

21. A method of driving a display member including a plurality of subpixels of P (P is an even number equal to or larger than 4) different colors, the plurality of subpixels being two-dimensionally arranged in a display area, a plurality of signal lines connected to the plurality of subpixels, and a plurality of scanning lines crossing the signal lines at different levels, wherein the plurality of signal lines are arranged in the display area in a first direction, and each extend in a second direction, the first direction and the second direction intersecting at right angles, wherein the plurality of signal lines are arranged in the display area in a first direction, and each extend in a second direction, the first direction and the second direction intersecting at right angles, wherein the plurality of scanning lines are arranged in the display area in the second direction and each extend in the first direction, wherein, if the plurality of signal lines are divided into a plurality of signal line groups, each being composed of Q (Q is a positive integer multiple of P) consecutive signal lines in the display area, the plurality of subpixels are two-dimensionally arranged in such a way that a sequence of subpixels of P different colors is repeated in the first direction, whereby, in a same row arranged in the first direction, the subpixels connected to each s-th (s is a positive integer between 1 and Q inclusive) signal line of each signal line group correspond to a single one of the P colors and are connected to a same one of the scanning lines, wherein, in the driving method, the plurality of scanning lines are sequentially driven, and if a first signal is applied to the s-th signal line of an odd-numbered signal line group in the display area, a second signal is applied, with a same timing, to the s-th signal line of an even-numbered signal line group in the display area, and the first signal and the second signal are each applied, with a same timing, to a corresponding one of the signal lines of each signal line group, the signal lines being adjacent to each other in the display area, wherein the signal lines of one of an odd-numbered signal line group and an even-numbered signal line group further extend into a non-display area of the display member, the non-display area being an area other than the display area, while maintaining an arrangement sequence in the display area, wherein the signal lines of the other of the odd-numbered signal line group and the even-numbered signal line group further extend into the non-display area, and an arrangement sequence of a u-th (u is an odd number between 1 and Q inclusive) signal line and a (u+1)-th signal line thereof is reversed in the non-display area, wherein, if the first signal is applied to an odd-numbered signal line in the non-display area, the second signal is applied to an even-numbered signal line in the non-display area.

22. The method of driving a display member of claim 21, wherein Q is equal to P.

23. The method of driving a display member of claim 21, wherein a plurality of sets of second parallel data strings are produced by applying a delay to first parallel data strings in synchronism with a first clock, the first parallel data strings being composed of color-by-color data strings on gray levels of the subpixels, wherein third parallel data strings are produced by sampling K (K is a positive integer smaller than P) pieces of data in parallel from the plurality of sets of second parallel data strings, in synchronism with a second clock having a frequency that is higher than a frequency of the first clock and in an order in which colors are arranged in the first direction in the display area, the third parallel data strings being composed of K data strings, wherein fifth parallel data strings are produced by sampling K pieces of data in parallel from the plurality of sets of fourth parallel data strings in synchronism with the second clock, in an order in which the signal lines are arranged in the non-display area, and in accordance with the colors of the subpixels connected to the signal lines, the fifth parallel data strings being composed of K data strings, wherein a drive signal is produced based on the fifth parallel data strings.

24. The method of driving a display member of claim 23, wherein K is equal to 3.

25. The method of driving a display member of claim 1, wherein the plurality of signal lines are divided into the signal line groups in such a way that the signal lines on both sides of the subpixel having a least colorful color of the P different colors belong to different signal line groups.

26. The method of driving a display member of claim 25, wherein the least colorful color is any one of white (W) and yellow (Y).

27. The method of driving a display member of claim 21, wherein the plurality of signal lines are divided into the signal line groups in such a way that the signal lines on both sides of the subpixel having a color with a lowest brightness of the P different colors belong to different signal line groups.

28. The method of driving a display member of claim 27, wherein the color with the lowest brightness is any one of blue (B) and magenta (M).

29. The method of driving a display member of claim 27, wherein the subpixel having the color with the lowest brightness is connected to one of the signal lines on both sides thereof, and the subpixel haying a least colorful color of the P different colors is connected to the other of the signal lines, wherein, in the driving method, for each pixel composed of the subpixels of P different colors, an amplitude of the drive signal for the subpixel having the least colorful color is set so as to be equal to or smaller than a smallest amplitude of amplitudes of the drive signals for the subpixels of other colors.

30. The method of driving a display member of claim 27, wherein the subpixel having the color with the lowest brightness is connected to one of the signal lines on both sides thereof, and the subpixel having a least colorful color of the P different colors is connected to the other of the signal lines, wherein, in the driving method, an amplitude of the drive signal to be applied to the other signal line is set so as to be equal to or smaller than an amplitude of the drive signal to be applied to the one signal line.

31. The method of driving a display member of claim 25, wherein, as backlight, either light haying a mixed color of the color of the subpixel disposed between the signal lines and white or light having a mixed color of a complementary color of the color of the subpixel disposed between the signal lines and white is shone onto the display member.

32. The method of driving a display member of claim 21, wherein the subpixel disposed between two signal lines adjacent to each other, the two signal lines each belonging to a corresponding one of the signal line groups adjacent to each other, has an aperture ratio lower than an aperture ratio of other subpixels.

33. The method of driving a display member of claim 21, wherein the subpixel disposed between two signal lines adjacent to each other, the two signal lines each belonging to a corresponding one of the signal line groups adjacent to each other, has an aperture ratio higher than an aperture ratio of other subpixels.

34. The method of driving a display member of claim 32, wherein the aperture ratio is set so that a brightness of the subpixel disposed between the two signal lines becomes equal to a brightness of the other subpixels at a time of gray display.

35. The method of driving a display member of claim 21, wherein, between two signal lines adjacent to each other, the two signal lines each belonging to a corresponding one of the signal line groups adjacent to each other, the subpixels of a plurality of colors are disposed in the second direction.

36. The method of driving a display member of claim 35, wherein, between the two signal lines, the subpixels of P different colors are repeatedly arranged in the second direction.

37. The method of driving a display member of claim 21, wherein an amplitude of the drive signal to be fed to the subpixel disposed between two signal lines adjacent to each other, the two signal lines each belonging to a corresponding one of the signal line groups adjacent to each other, is corrected based on an amplitude of the drive signal to be applied to one signal line of the two signal lines, the one signal line that is not connected to the subpixel disposed between the two signal lines.

38. The method of driving a display member of claim 21, wherein an amplitude of the drive signal to be fed to each subpixel is corrected based on an amplitude of the drive signal to be applied to the signal line adjacent thereto.

39. The method of driving a display member of claim 21, wherein P different colors are any one of four different colors of red (R), green (G), blue (B), and white (W), four different colors of red (R), green (G), blue (B), and yellow (Y), four different colors of cyan (C), magenta (M), yellow (Y), and green (G), or six different colors of red (R), green (G), blue (B), cyan (C), magenta (M), and yellow (Y).

40. The method of driving a display member of claim 21, wherein the display member is a liquid crystal panel.

* * * * *